US011677173B2

(12) United States Patent
Zhang et al.

(10) Patent No.: US 11,677,173 B2
(45) **Date of Patent: *Jun. 13, 2023**

(54) ELECTRICAL CONNECTOR WITH INCREASED CONDUCTIVE PATHS

(71) Applicant: ALLTOP ELECTRONICS (SUZHOU) LTD., Suzhou (CN)

(72) Inventors: Zhihui Zhang, Suzhou (CN); Dingbin Yin, Suzhou (CN)

(73) Assignee: ALLTOP ELECTRONICS (SUZHOU) LTD., Suzhou (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/446,150

(22) Filed: Aug. 26, 2021

(65) Prior Publication Data

US 2022/0102890 A1 Mar. 31, 2022

Related U.S. Application Data

(63) Continuation of application No. 17/033,344, filed on Sep. 25, 2020, now Pat. No. 11,139,599.

(51) Int. Cl.

| | |
|---|---|
| ***H01R 13/04*** | (2006.01) |
| ***H01R 4/02*** | (2006.01) |
| ***H01R 4/70*** | (2006.01) |
| ***H01R 4/62*** | (2006.01) |
| ***H01R 107/00*** | (2006.01) |

(52) U.S. Cl.

CPC ..... *H01R 13/04* (2013.01); *H01R 4/025* (2013.01); *H01R 4/625* (2013.01); *H01R 4/70* (2013.01); *H01R 2107/00* (2013.01)

(58) Field of Classification Search

CPC ... H01R 13/115; H01R 13/113; H01R 13/112; H01R 13/11; H01R 13/187; H01R 13/04; H01R 4/025; H01R 4/70; H01R 4/625; H01R 2107/00

USPC ..... 439/850, 856, 857, 845

See application file for complete search history.

(56) References Cited

U.S. PATENT DOCUMENTS 10,826,215 B2 * 11/2020 Zhang ..... H01R 13/04
11,139,599 B2 * 10/2021 Zhang ..... H01R 4/625

* cited by examiner

*Primary Examiner* — Gary F Paumen
(74) *Attorney, Agent, or Firm* — Cheng-Ju Chiang

(57) ABSTRACT

An electrical connector includes an insulative housing having a mating cavity and a plurality of power contact pairs. Each power contact pair defines an upper contact set and a lower contact set, each one of the upper contact set and the lower contact set comprises a first contact unit and a second contact unit, each one of the first contact unit and the second contact unit has a retaining portion and at least one contacting portion extending from the retaining portion into the mating cavity. The retaining portions of the upper contact set are arranged in a height direction of the insulative housing with the contacting portions thereof arranged in a transverse direction of the insulative housing, the retaining portions of the lower contact set are arranged in the height direction with the contacting portions thereof arranged in the transverse direction.

8 Claims, 22 Drawing Sheets

ELECTRICAL CONNECTOR WITH INCREASED CONDUCTIVE PATHS

CROSS REFERENCE TO RELATED APPLICATIONS

The present application is a continuation application of U.S. patent application Ser. No. 17/033,344 filed on Sep. 25, 2020, which is a continuation application of U.S. patent application Ser. No. 16/571,015 filed on Sep. 13, 2019, the content of which is hereby incorporated by reference into this application.

BACKGROUND OF THE INVENTION

1. Field of the Invention

The present invention relates to an electrical connector, and more particularly to an electrical connector with increased conductive paths and can suppress heating of contacts effectively.

2. Description of Related Art

Each power contact of a traditional electrical connector comprises at least one contacting arm forming on a front end of a metallic sheet, however when the electric connector transmits current, the highest temperature position of its power contact is the contacting area of the contact arm, and as the contacting mean of the contacting area is only a linear contacting, the current channel is limited. In the case of the power contact has a limited width, the power contact is prone to generate heat due to current impedance, thereby resulting in high temperature at the contacting area.

Hence, it is desired to provide an electrical connector to overcome the problems mentioned above.

BRIEF SUMMARY OF THE INVENTION

Accordingly, an object of the present invention is to provide an electrical connector preventing contacts thereof heating effectively.

The present invention is directed to an electrical connector comprising an insulative housing having a mating cavity and a plurality of power contact pairs correspondingly mounted in the insulative housing. Each power contact pair defines an upper contact set and a lower contact set, each one of the upper contact set and the lower contact set comprises a first contact unit and a second contact unit, each one of the first contact unit and the second contact unit has a retaining portion fixed in the insulative housing and at least one contacting portion extending from the retaining portion into the mating cavity. The retaining portions of the upper contact set are arranged in a height direction of the insulative housing with the contacting portions thereof arranged in a transverse direction of the insulative housing, the retaining portions of the lower contact set are arranged in the height direction of the insulative housing with the contacting portions thereof arranged in the transverse direction of the insulative housing.

The present invention is also directed to an electrical connector assembly comprising an insulative housing having a mating cavity and a plurality of power contacts defined in the insulative housing. The power contacts have a plurality of retaining portions fixed in the insulative housing and a plurality of contacting portions extending from corresponding retaining portions into the mating cavity in a same direction. A plurality of contact sets are formed by the plurality of power contacts, each contact set comprises a first power contact with the retaining portion on an upper side and a second power contact with the retaining portion on a lower side, the contacting portions of the first power contact and the second power contact in a same contact set are arranged in a transverse direction of the insulative housing to contact with a same side of a complementary member.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
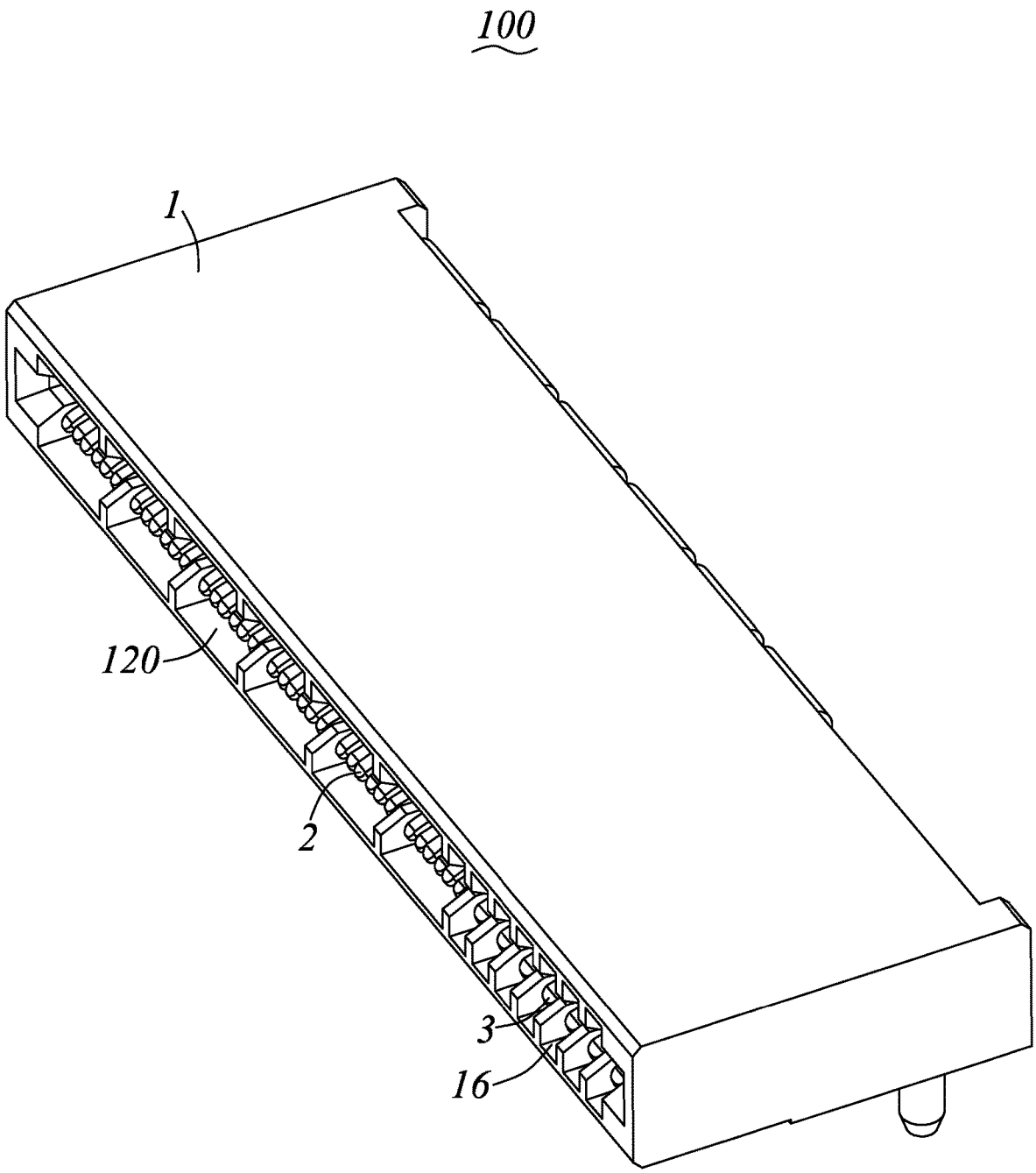
FIG. 1 is an assembled perspective view of an electrical connector in accordance with a first embodiment of the present invention.

Reference will be made to the drawing figures to describe the present invention in detail, wherein depicted elements are not necessarily shown to scale and wherein like of similar elements are designated by same or similar reference numeral through the several views and same or similar terminology.

FIGS. 1-9 illustrate an electrical connector 100 according to a first embodiment of the present invention, and the electrical connector 100 comprises an insulative housing 1 having a mating cavity 120 and a plurality of power contacts 21 held in the insulative housing 1. The power contacts 21 are defined in pairs oppositely in the insulative housing 1, and two pairs of power contacts 21 oppositely are referred to as a power contact pair 2 in the subsequent description.

In order to express convenience, hereinafter, a mating end of the electrical connector 100 is defined as a front end and another end opposite to the mating end is defined as a rear end, that is to say, a front-and-back direction (also can be called a longitudinal direction) is same as the plugging direction of the electrical connector 100 mating with a complementary member (not shown). At the same time, one direction perpendicular to the front-and-back direction is called as a transverse direction, and another direction perpendicular to the front-and-back direction is called as a height direction. In this case, the insulative housing 1 has a larger dimension in the transverse direction than in the height direction and the front-and-back direction.

As illustrated in FIGS. 1 to 4 and FIGS. 8-9, in this case, the insulative housing 1 has a main section 11 used for mounting on a printed circuit board, a mating section 12 extending forwardly from the main section 11, a plurality of first contact-receiving passageways 13 extending along the front-and-back direction and a plurality of barriers 14 extending along the front-and-back direction. One barrier 14 is arranged between each two neighboring first contact-receiving passageways 13 in the transverse direction. Each first contact-receiving passageway 13 is penetrating through the insulative housing 1 along the front-and-back direction, and each barrier 14 extends forwards from the main section 11 to a front end 121 of the mating section 12.

The mating section 12 defines the mating cavity 120 opening forwards to receive the complementary member, and the first contact-receiving passageways 13 are communicated with the mating cavity 120.

In this embodiment, the insulative housing 1 defines two rows of first contact-receiving passageways 13 and an interval wall 15 between two rows of first contact-receiving passageways 13. Two rows of first contact-receiving passageways 13 include an upper row of first contact-receiving passageways 13 and a lower row of first contact-receiving passageways 13. The interval wall 15 is extending along the transverse direction and formed in the main section 11, thus to separate the upper row of first contact-receiving passageways 13 from the lower row of first contact-receiving passageways 13. Further, the interval wall 15 extends forwards to a front surface of the main section 11, but does not extend forwards into the mating section 12.

The main section 11 has a first mounting face 111, a second mounting face 112 and a third mounting face 113 at the back side thereof, the first mounting face 111, the second mounting face 112 and the third mounting face 113 are spaced apart from each other along the front-and-back direction. Herein, the third mounting face 113, the second mounting face 112 and the first mounting face 111 are sequentially arranged along a front-to-back direction.

Figure 4:
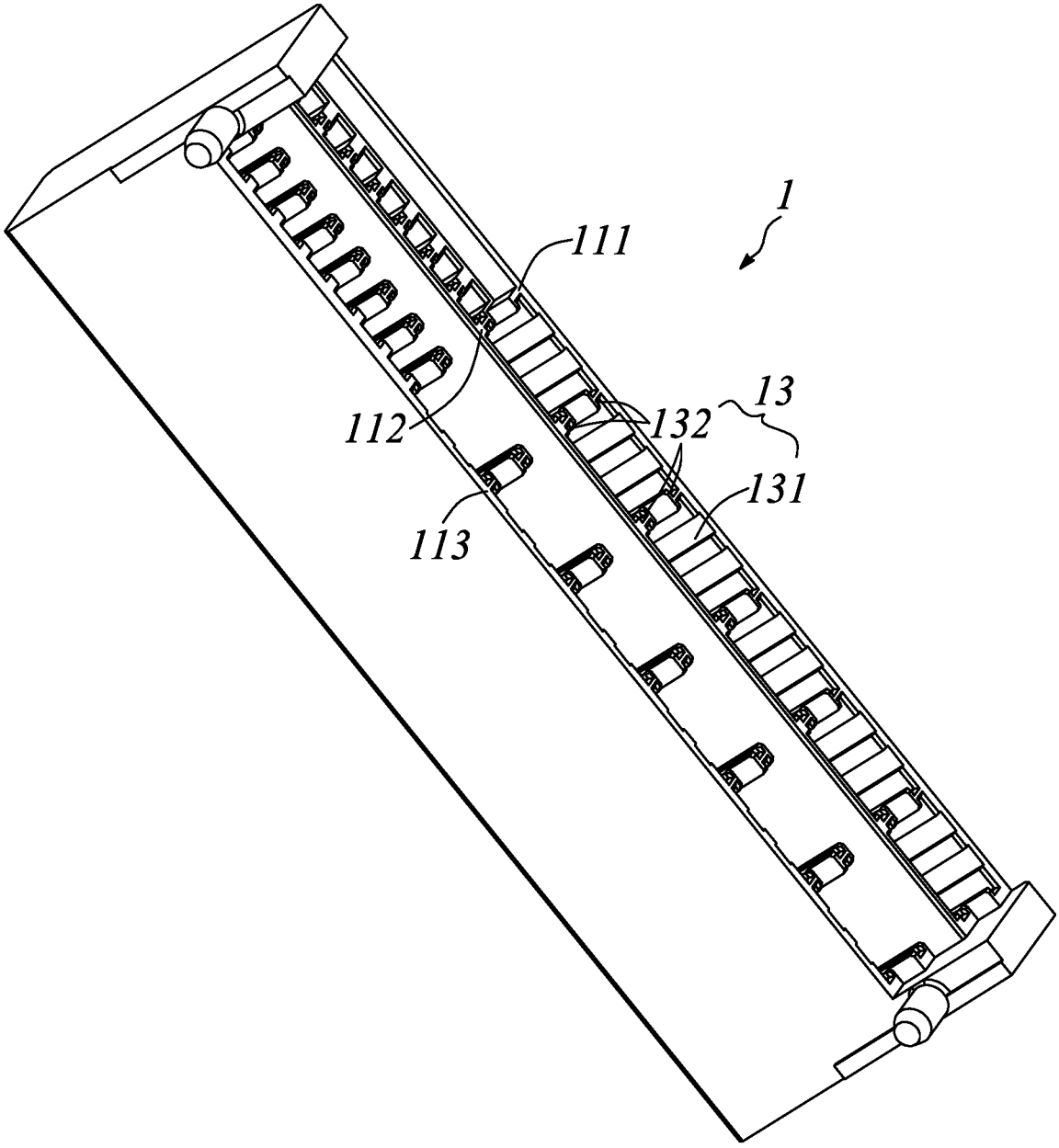
FIG. 4 is a perspective view of an insulative housing of the electrical connector shown in FIG. 2.
Figure 9:
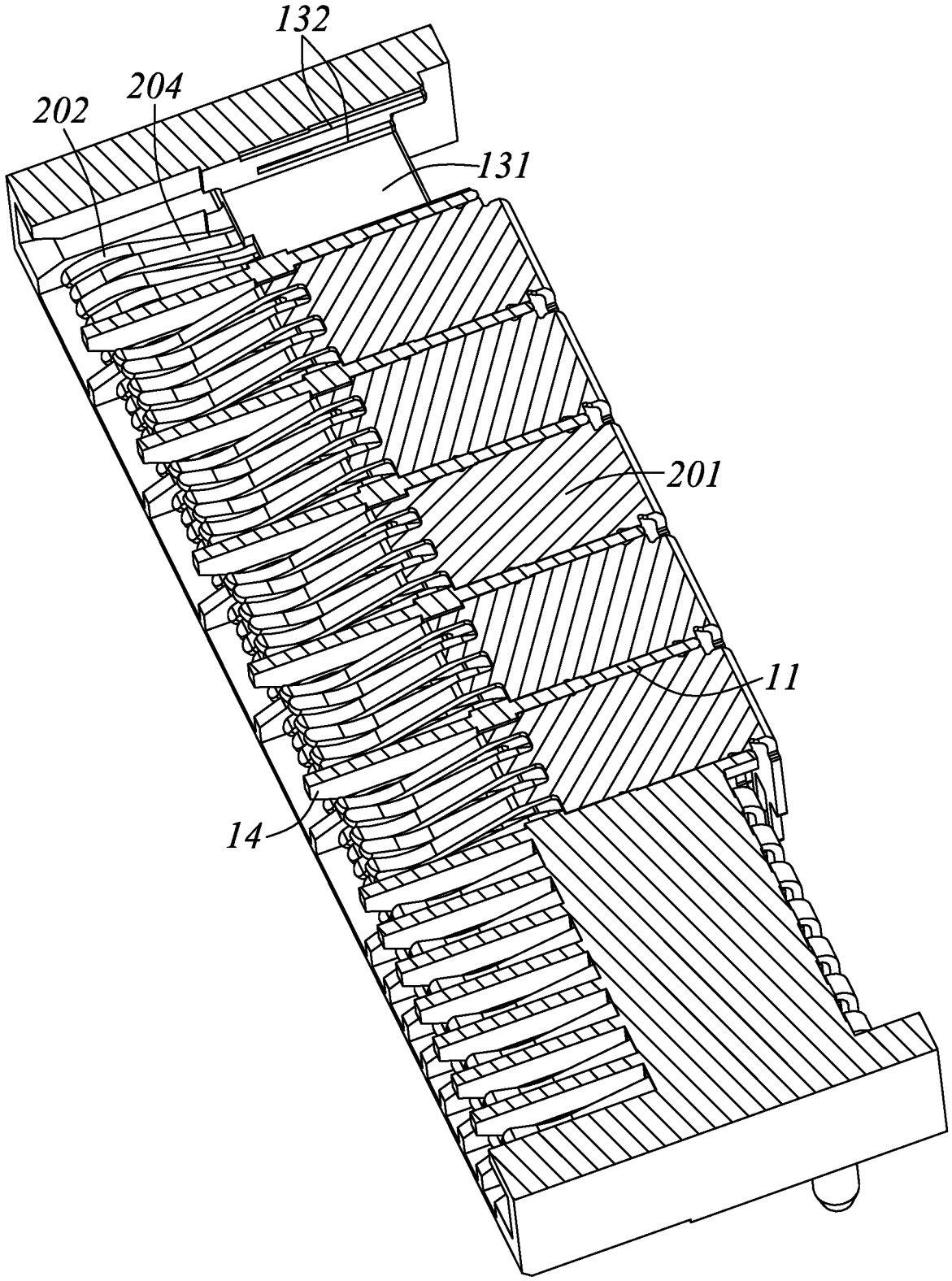
FIG. 9 is a cross-section view of the electrical connector of FIG. 1, and showing one contact removed away.
Figure 10:
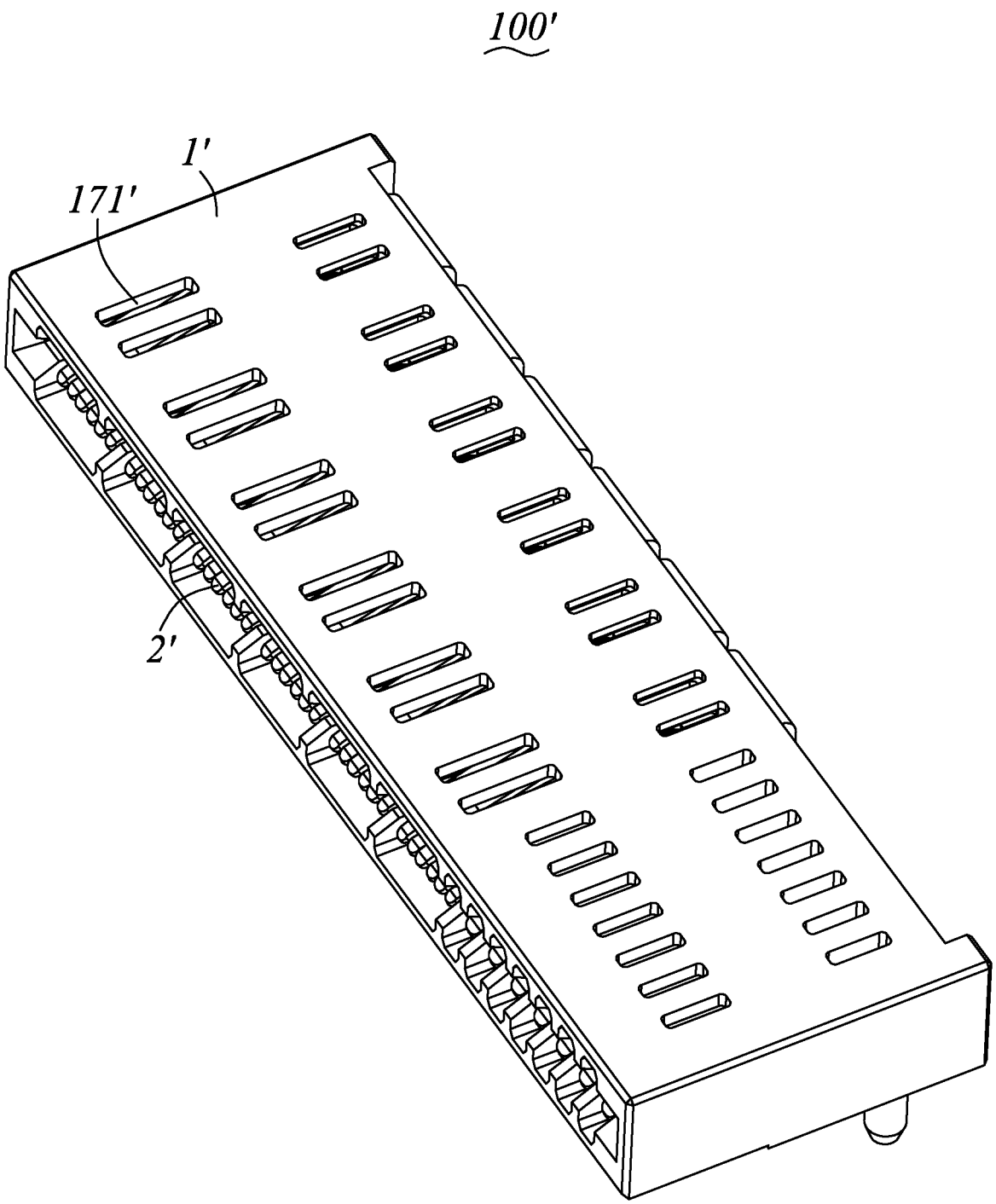
FIG. 10 is an assembled perspective view of an electrical connector according to a second embodiment of the present invention.
Figure 11:
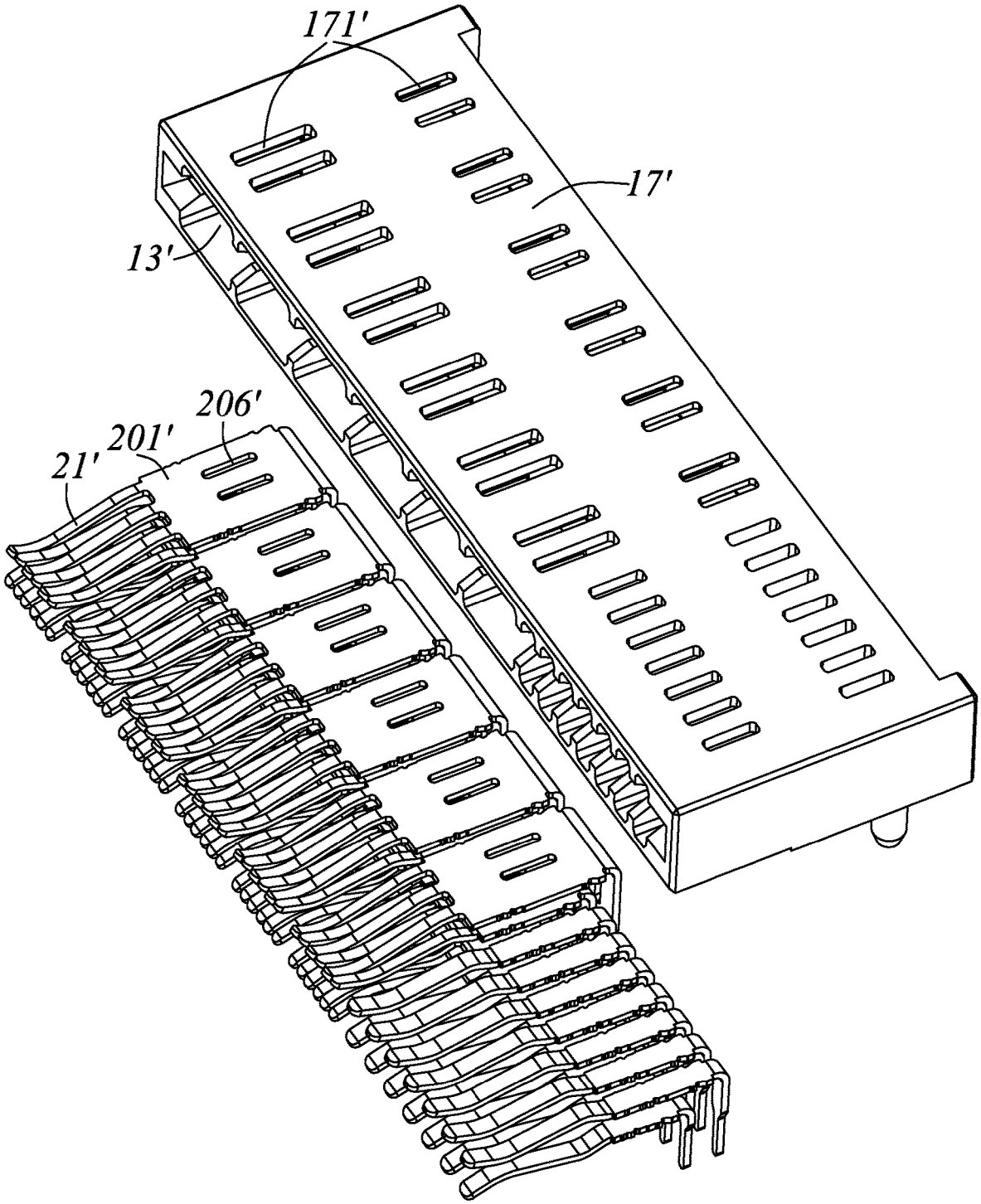
FIG. 11 is an exploded view of the electrical connector shown in FIG. 10.
Figure 12:
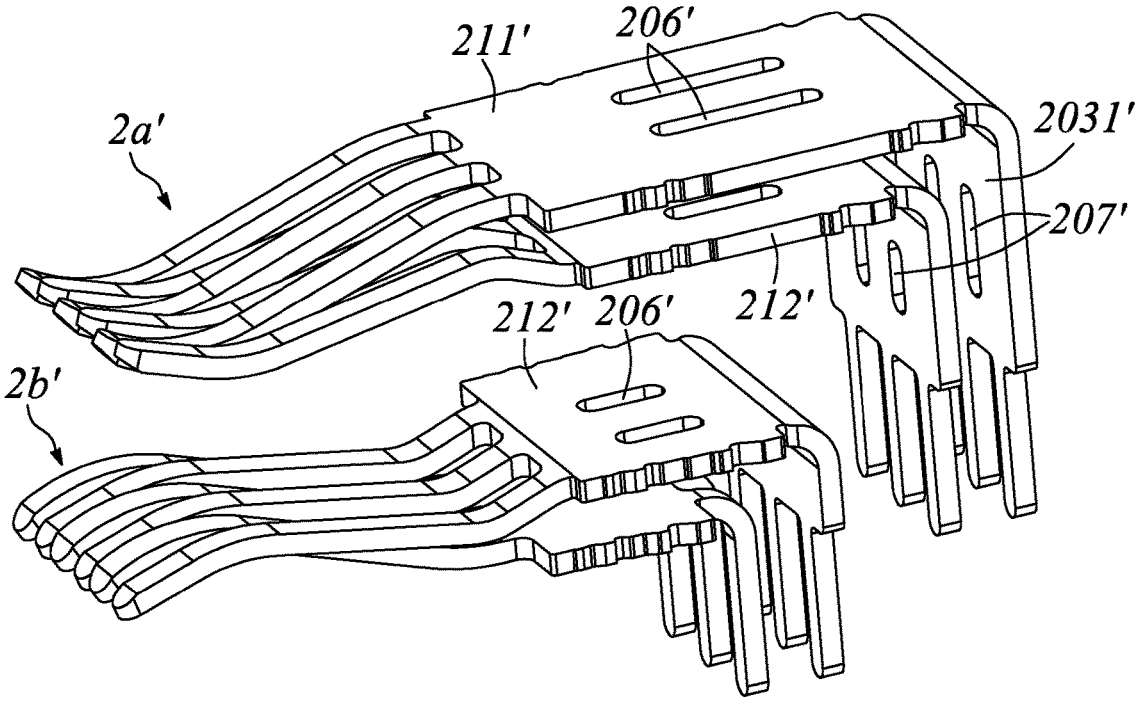
FIG. 12 is an exploded view of a power contact pair of the electrical connector shown in FIG. 11.
Figure 13:
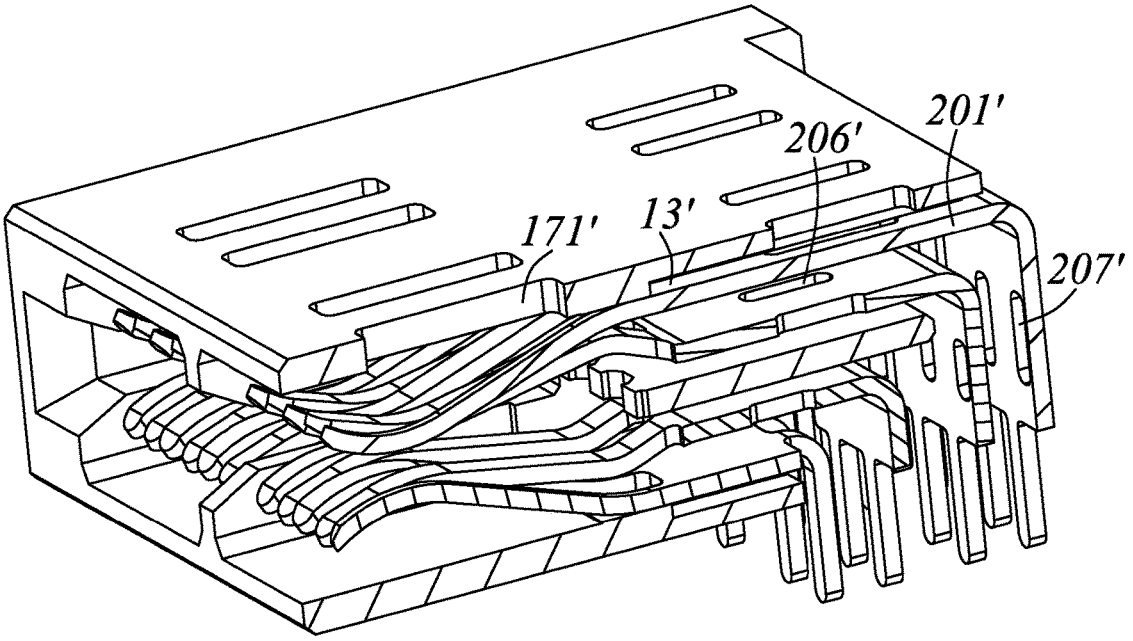
FIG. 13 is a cross-section view of the electrical connector shown in FIG. 10.
Figure 14:
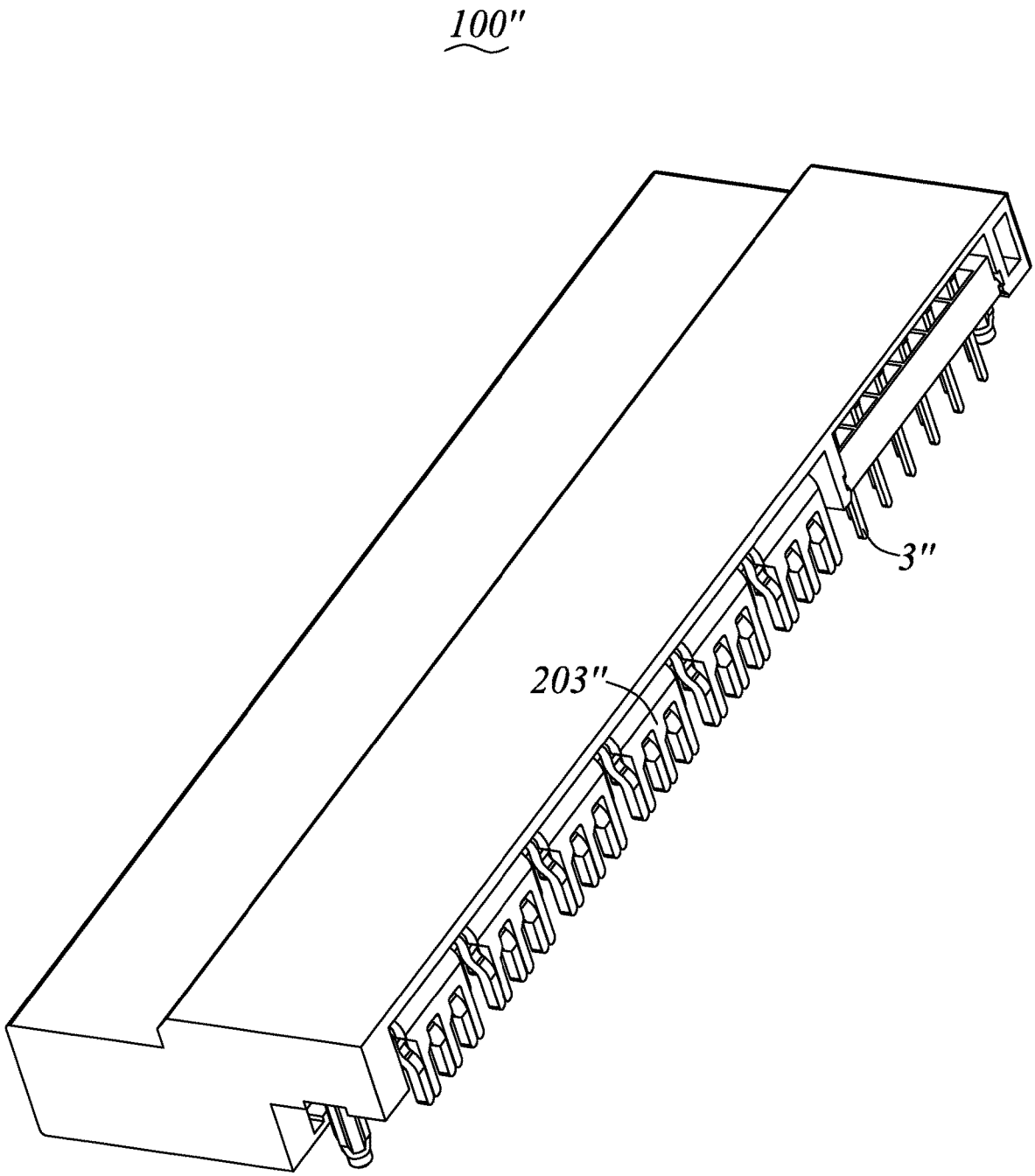
FIG. 14 is a perspective view of an electrical connector according to a third embodiment of the present invention.
Figure 15:
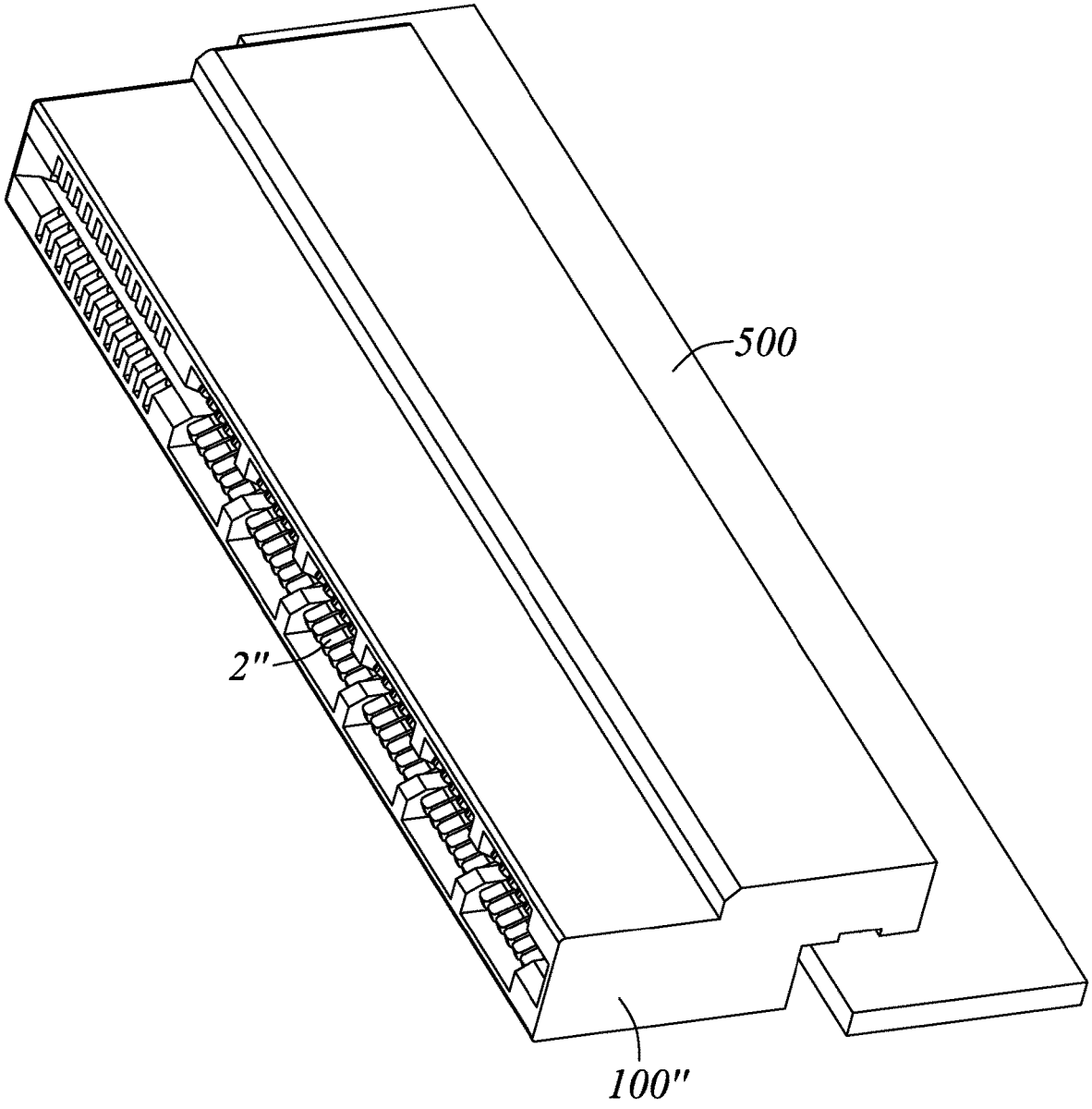
FIG. 15 is a perspective view of the electrical connector of FIG. 14 installed on a printed circuit board to form an electrical connector assembly.
Figure 16:
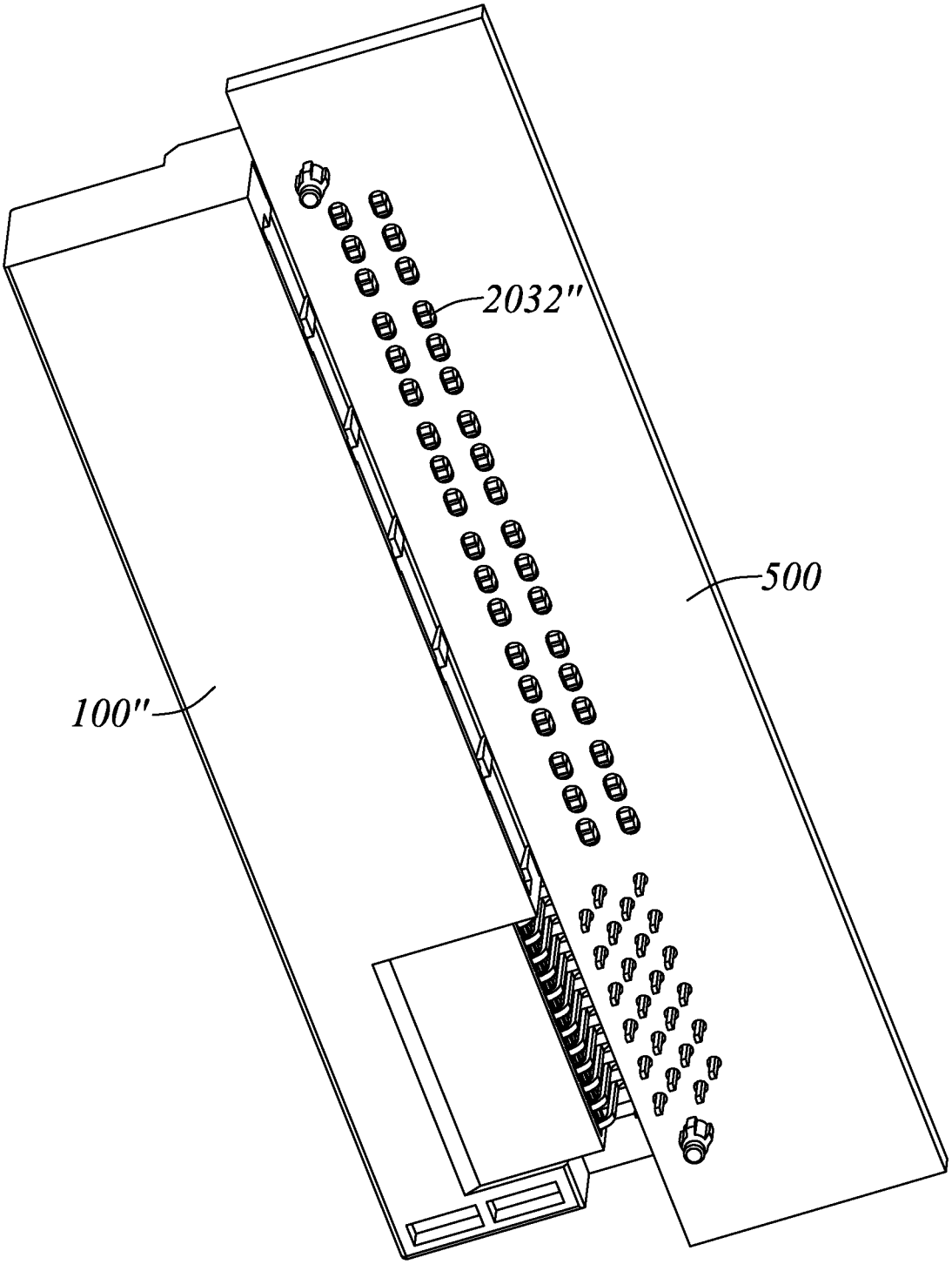
FIG. 16 is a view similar to FIG. 15, but viewed from a different angle.
Figure 17:
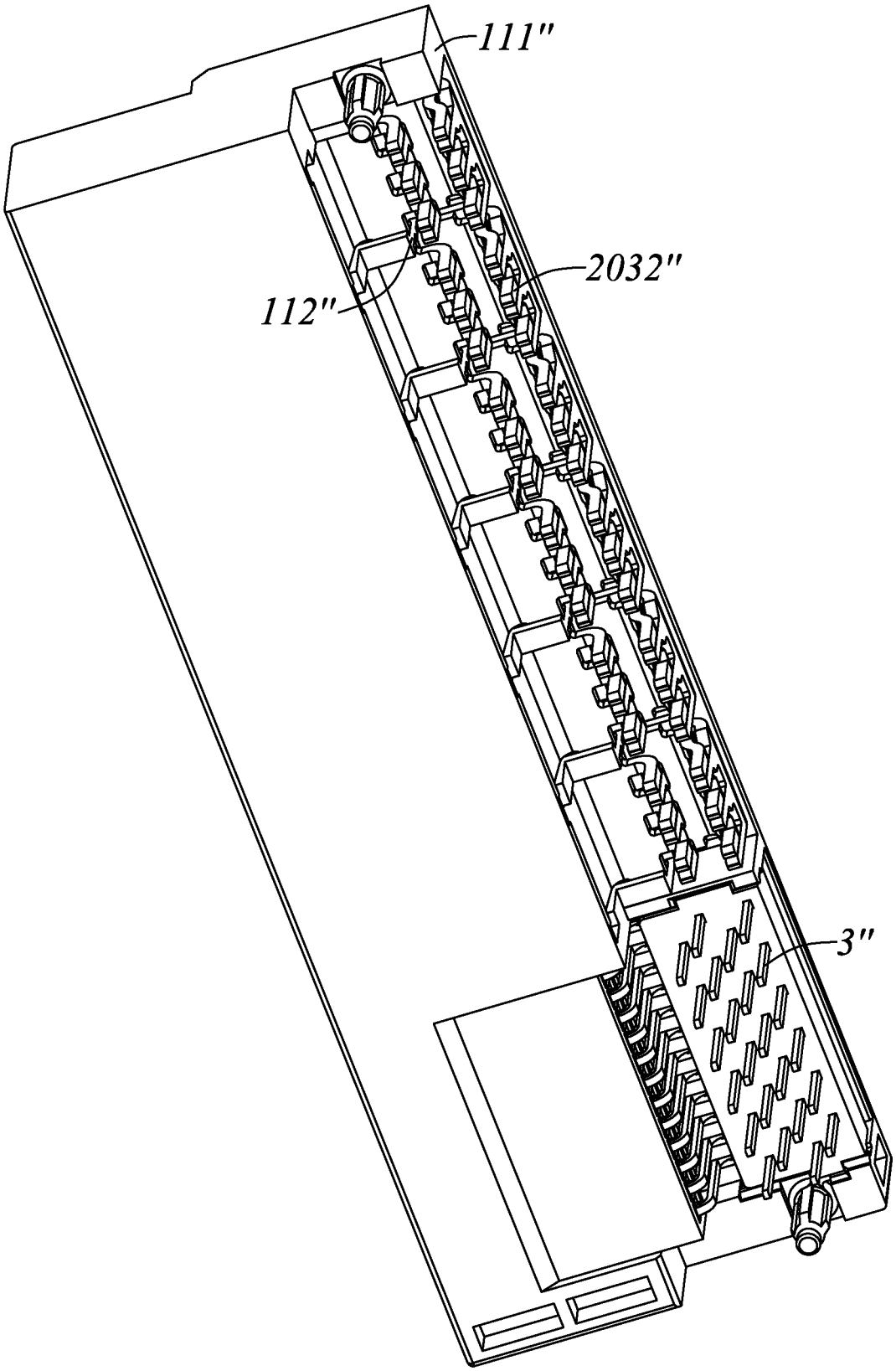
FIG. 17 is a view similar to FIG. 14, but viewed from another aspect.
Figure 18:
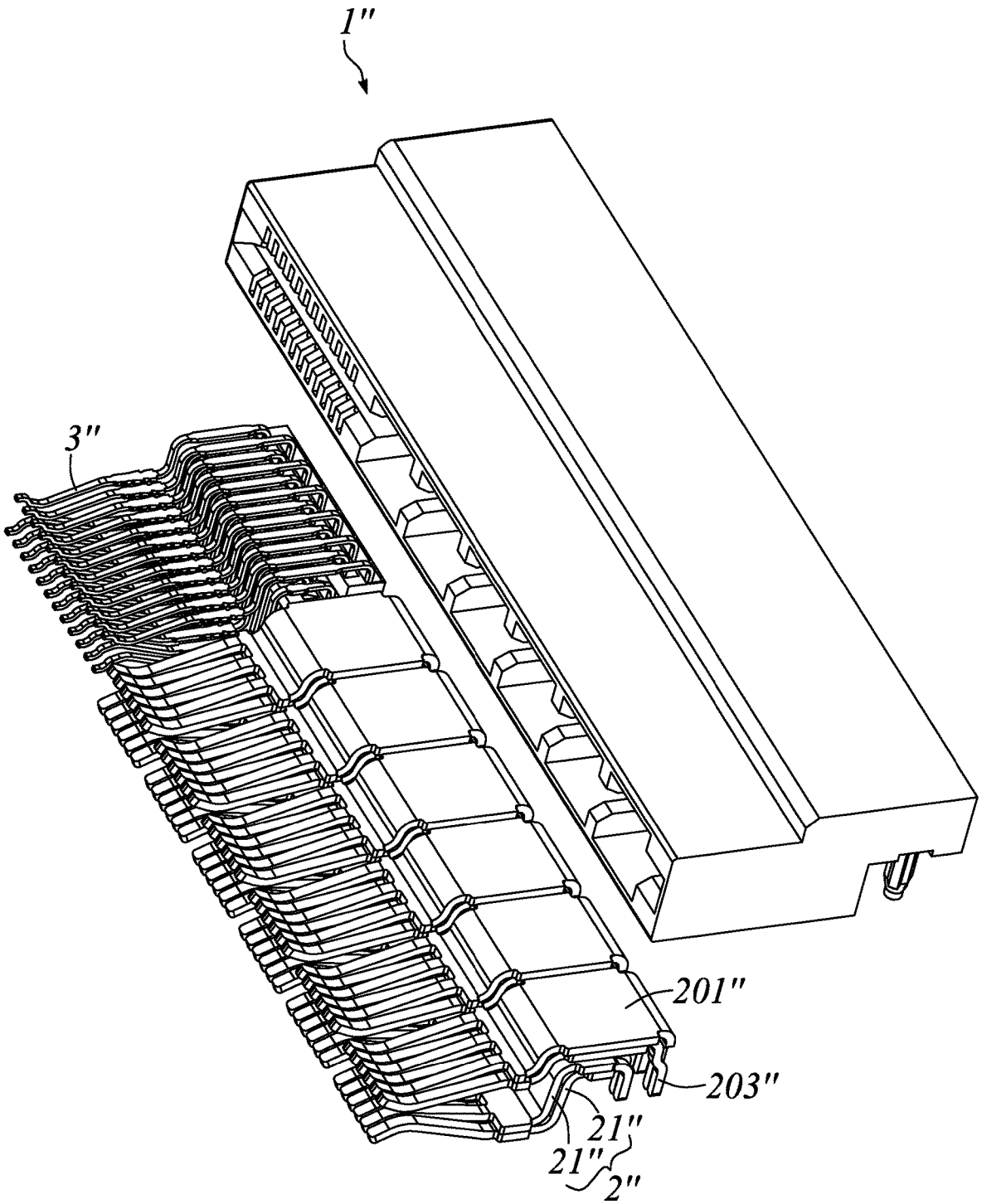
FIG. 18 is a partially exploded perspective view of the electrical connector of FIG. 14.

As illustrated in FIGS. 4 and 9, in this case, each first contact-receiving passageway 13 comprises a channel 131 penetrating through the main section 11 along the front-and-back direction and a plurality of fixing slots 132 communicated with the channel 131, the fixing slots 132 are arranged in pairs and symmetrically. And in this embodiment, each first contact-receiving passageway 13 has two pairs of fixing slots 132 spaced apart from each other along the height direction, two fixing slots 132 in each pair are disposed on both sides of the channel 131 along the transverse direction. In a same first contact-receiving passageway 13, each fixing slot 132 on an upper side has a larger extending length than the fixing slot 132 on a lower side in the front-and-back direction.

Referring to FIGS. 5-9, each power contact pair 2 includes an upper contact set 2*a* received in corresponding first contact-receiving passageways 13 in the upper row and a lower contact set 2*b* received in corresponding first contact-receiving passageways 13 in the lower upper row. Each upper contact set 2*a* is formed by the power contacts 21 on an upper side of the paired power contacts, each lower contact set 2*b* is formed by the power contacts 21 on a lower side of the paired power contacts.

Each one of the upper contact set 2*a* and the lower contact set 2*b* comprises a first contact unit and a second contact unit, each one of the first contact unit and the second contact unit has a retaining portion 201 fixed in corresponding first contact-receiving passageways 13 of the insulative housing 1, at least one contacting portion 202 extending from the retaining portion 201 into the mating cavity 120 and a soldering portion 203 extending out of the insulative housing 1. The retaining portions 201 of the upper contact set 2*a* are arranged in the height direction of the insulative housing 1 with the contacting portions 202 thereof arranged in the transverse direction of the insulative housing 1, the retaining portions 201 of the lower contact set 2*b* are arranged in the height direction of the insulative housing 1 with the contacting portions 202 thereof arranged in the transverse direction of the insulative housing 1.

Each one of the upper contact set 2*a* and the lower contact set 2*b* comprises a first contact unit and a second contact unit, each one of the first contact unit and the second contact unit has a retaining portion 201 fixed in corresponding first contact-receiving passageway 13 of the insulative housing 1 and at least one contacting portion 202 extending from the retaining portion 201 into the mating cavity 120. The retaining portions 201 of the upper contact set 2*a* are arranged in a height direction of the insulative housing 1 with the contacting portions 202 thereof arranged in the transverse direction of the insulative housing 1, the retaining portions 201 of the lower contact set 2*b* are arranged in the height direction of the insulative housing 1 with the contacting portions 202 thereof arranged in the transverse direction of the insulative housing 1.

Figure 5:
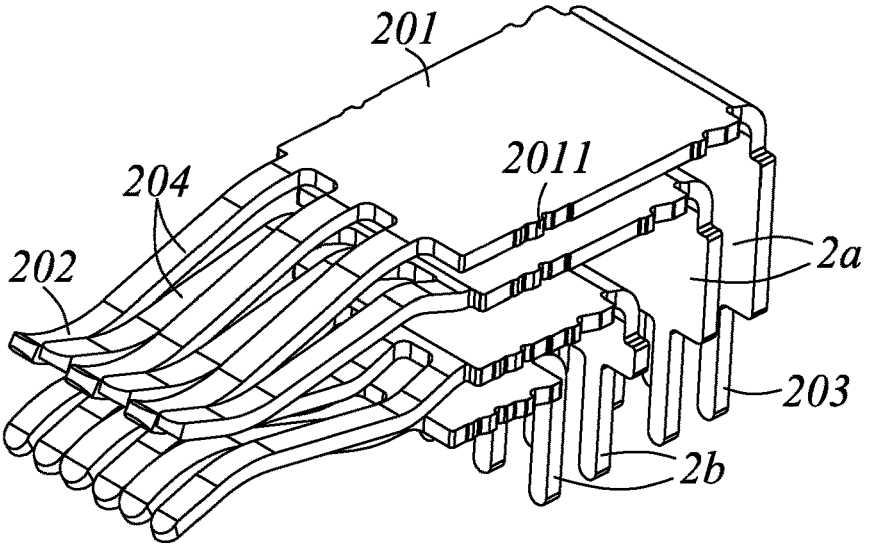
FIG. 5 is a perspective view of a power contact pair of the electrical connector shown in FIG. 2.
Figure 7:
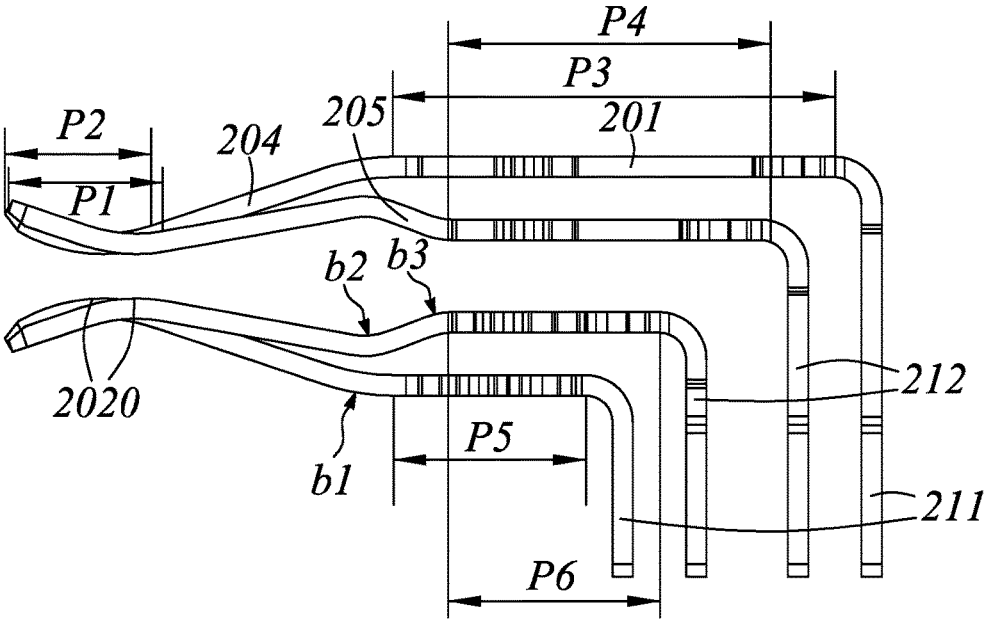
FIG. 7 is a side view of FIG. 5.

In the height direction of the insulative housing 1, projections of the retaining portions 201 of each upper contact set 2*a* on a horizontal plane are overlapping, projections of the retaining portions 201 of each lower contact set 2*b* on the horizontal plane are overlapping. As shown in FIGS. 5 and 7, in each upper contact set 2*a*, the first contact unit has a projection P3 on a horizontal plane overlapped with a projection P4 on the horizontal plane of the second contact unit; in each lower contact set 2*b*, the first contact unit has a projection P5 on a horizontal plane overlapped with a projection P6 on the horizontal plane of the second contact unit.

In each upper contact set 2*a*, the contacting portions 202 of the first contact unit and the second contact unit are disposed on an upper side of the mating cavity 120 along the height direction of the insulative housing 1, to contact with one side of a complementary member, and in each lower contact set 2*b*, the contacting portions 202 of the first contact unit and the second contact unit are disposed on an lower side of the mating cavity 120 along the height direction of the insulative housing 1, to contact with the other side of the complementary member.

In the preferred embodiment of the present invention, the contacting portions 202 of the upper contact set 2*a* (i.e., including the contacting portion 202 of the first contact unit and the contacting portion 202 of the second contact unit) are disposed on a same plane to connect with a same side of the complementary member. Of course, in other implementations of the present invention or due to the limitations of the molding or installation process during the molding process, the contacting portion 202 of the first contact unit and the second contact unit in the upper contact set 2*a* may have a certain position deviation in the height direction, or be misaligned. As long as the electrical connector 100 is mating with the complementary member, the contacting portions 202 of the upper contact sets 2*a* can be steadily connected to a same side of the complementary member, i.e., the contacting portions 202 of the upper contact sets 2*a* are located on a same horizontal plane in the height direction when mated. In the present invention, the contacting portions 202 of the first contact unit and the second contact unit in the lower contact set 2*b* are disposed equivalent to the contacting portion 202 in the upper contact unit 2*a*.

In each upper contact set 2*a*, the retaining portions 201 of the first contact unit and the second contact unit are adjacent to each other in the height direction of the insulative housing 1, the contacting portions 202 of the first contact unit and the second contact unit are adjacent to each other in the transverse direction of the insulative housing 1.

In each upper contact set 2*a* and each lower contact set 2*b* respectively, the retaining portion 201 of the second contact unit is closer to a horizontal center surface of the mating cavity 120 than the retaining portion 201 of the first contact unit, and bending times between the retaining portion 201 and the contacting portion 202 of the second contact unit is greater than bending times between the retaining portion 201 and the contacting portion 202 of the first contact unit. More specifically, for example as shown in FIG. 7, the first contact unit has one bending portion b1 between the retaining portion 201 and the contacting portion 202 thereof, and the second contact unit has a pair of bending portions b2, b3 between the retaining portion 201 and the contacting portion 202 thereof.

Figure 6:
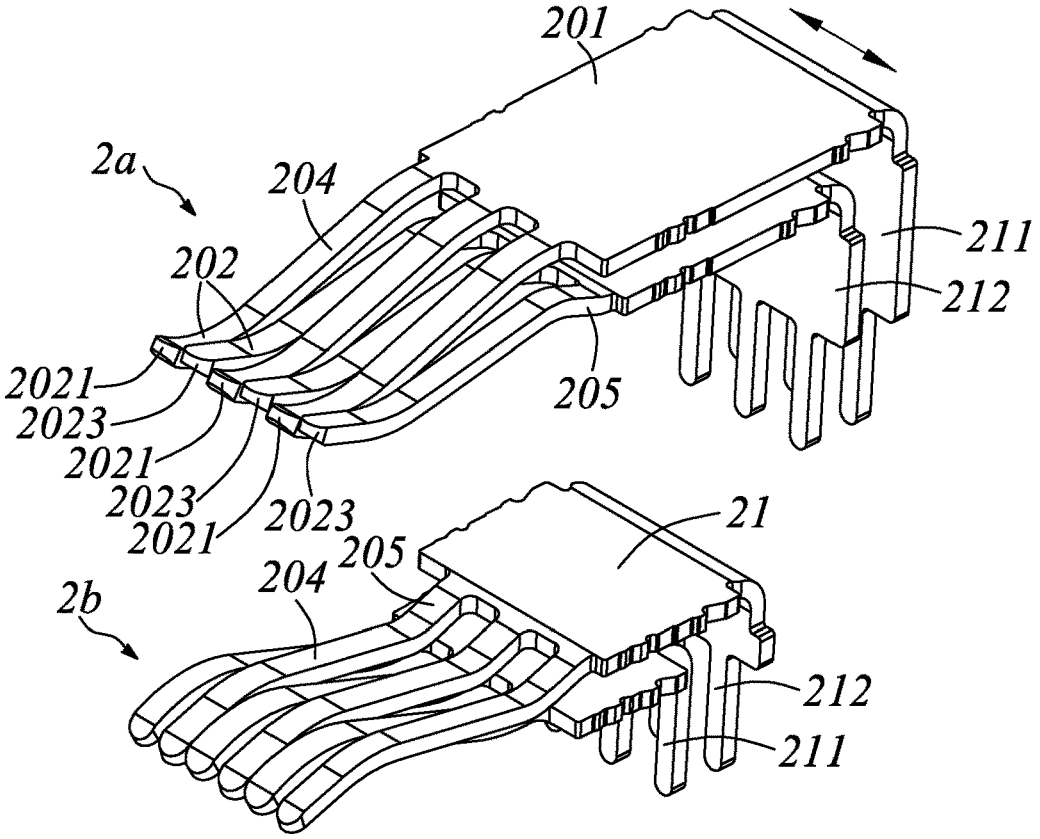
FIG. 6 is an exploded view of the power contact pair shown in FIG. 5.

In the present invention, for example, the upper contact set 2*a* and the lower contact set 2*b* have two contact units each, i.e., only the first contact unit and the second contact unit are included for detailed description. In this embodiment, each contact unit has a plurality of contacting portions 202 extending forward from one end of the retaining portion 201 and the soldering portion 203 extending from the other end of the retaining portion 201. The contacting portions 202 of the two contact units are arranged alternately and circularly. More specifically, as shown in FIG. 6, take the upper contact set 2*a* as an example, the first contact unit has a plurality of contacting portions 2021, the second contact unit has a plurality of contacting portions 2023, and the contacting portions 2021, 2023 of the first and second contact unit are arranged alternately and circularly in the transverse direction (as a direction indicated by an arrow shown in FIG. 6).

In addition, in terms of usage or naming conventions, each contact unit can also be regarded as a power contact 21, by now each upper contact set 2*a* and each lower contact set 2*b* can also be called a contact set respectively, and in each contact set, the power contact with the retaining portion 201 on an upper side is the first power contact, and the power contact with the retaining portion 201 on a lower side is the second power contact. The contact portions 202 of the first power contact and the second power contact are arranged in the horizontal direction of the insulative housing 1 to contact a same side of the complementary member. That is, the first contact unit of the upper contact set 2*a* can also be called the first power contact with the second contact unit called the second power contact; the second contact unit of the lower contact 2*b* is called the first power contact with the first contact unit called the second power contact. In the height direction of the insulative housing 1, projections of the retaining portions 201 of the first power contact and the second power contact on a horizontal plane are overlapping.

The upper contact sets 2*a* and the lower contact sets 2*b* are arranged in pairs along the height direction, opposite to each other in the height direction and arranged at intervals. In the front-and-back direction, the soldering portions 203 of the upper contact sets 2*a* are located behind the second mounting face 112, and the soldering portions 203 of the lower contact sets 2*b* are located between the second mounting face 112 and the third mounting face 113.

In further, in this embodiment, each power contact 21 has three contacting portions 202 extending forwards from the retaining portion 201, and the retaining portion 201 is a lamellar structure parallel to a horizontal plane. Each contacting portion 202 is curved, and has a contacting area 2020 protruding towards the interval wall 15.

The contacting portions 202 of the first contact unit and the second contact unit in each upper contact set 2*a* are staggered in a front-and-back direction, the contacting portions of the first contact unit and the second contact unit in each lower contact set 2*b* are staggered in the front-and-back direction. Therefore, while the complementary member plugged in, two staggered columns of contacting portions 202 can be contacting with the complementary member successively, to achieve multi-level and multi-point contact and make the contact more fully, and the stability of electrical connection and current transfer of the electrical connector 100 can be enhanced. At the same time, the insertion and pulling force between the electrical connector 100 and the complementary member is evenly distributed, and the calorific value of the contacting surface is reduced.

Figure 8:
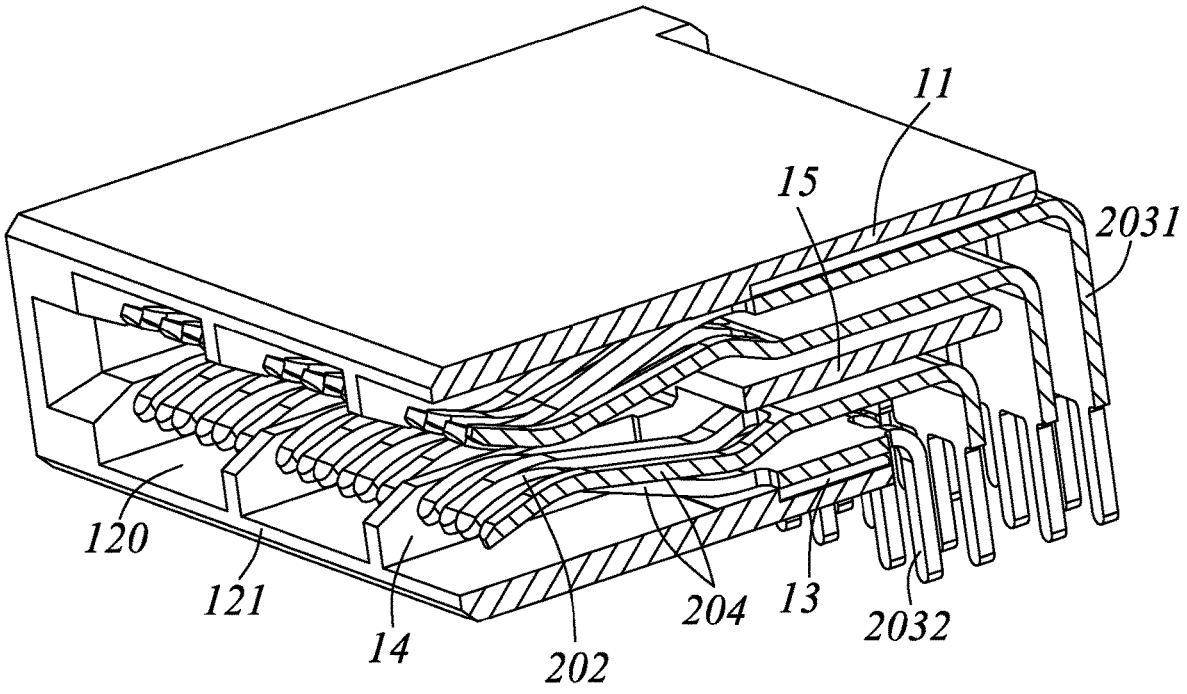
FIG. 8 is a sectional view of FIG. 1.

Please referring to FIGS. 6-8, as the retaining portion 201 of the second contact unit is located closer to the horizontal center surface of the mating cavity 120 than the retaining portion 201 of the first contact unit, therefore the first contact unit is called as an outer contact 211 and the second contact unit is called as an inner contact 212 in the upper contact set 2*a* and the lower contact set 2*b*. Wherein, compared with the outer contact 211, the retaining portion 201 and the contacting portions 202 of the inner contact 212 are closer to the interval wall 15 of the insulative housing 1, that is, closer to the horizontal center surface of the mating cavity 120. In each power contact pair 2 along the front-and-back direction, the contacting areas 2020 of the outer contact 211 are placed in front of the contacting areas 2020 of the inner contact 212. Thus, the contacting areas 2020 of the outer contacts 211 contact the complementary member first, and then the contacting areas 2020 of the inner contacts 211 contact the complementary member, in this way, the insertion and pulling force can be reduced to make the insertion feel better, and a deformation and a failure of an elastic contacting arm of each power contact 21 after long-term insertion and extraction can be avoided, so as to ensure a long-term electrical connection.

The retaining portions 201 of the first contact unit and the second contact unit in a same upper contact set 2*a* are spaced apart from each other in the height direction, and inserted into a same first contact-receiving passageway 13 from a rear side of the main section 11. The retaining portions 201 of the first contact unit and the second contact unit in a same lower contact set 2*b* are defined same as that of the upper contact set 2*a*. Each retaining portion 201 defines a plurality of interferential portions 2011 on lateral sides in the transverse direction, and the interferential portions 2011 are protruding outwards to engage with the corresponding fixing slots 132 by an interference fit.

As illustrated in FIG. 7, in an up-to-down direction, the lengths of the retaining portions 201 of four power contacts 21 in each pair of the upper contact set 2*a* and the lower contact set 2*b* in the front-and-back direction are decreased successively, that is to say, in each upper contact set 2*a*, the retaining portion 201 of the first contact unit is longer than that of the second contact unit along the front-and-back direction. Among each lower contact set 2*b*, the retaining portion 201 of the first contact unit has a larger length than that of the second contact unit along the front-and-back direction. Additionally, the retaining portion 201 of the second contact unit of each upper contact set 2*a* has a larger length than that of the first contact unit of each lower contact set 2*b*.

Also shown in FIG. 7, a side view of a group of power contact pairs on a vertical plane is illustrated, one of two neighboring contacting portions 202 in a same row has a projection P1 on a vertical plane at least partially overlapped with a projection P2 on the vertical plane of the other of two neighboring contacting portions 202.

In this embodiment as shown, each soldering portion 203 comprises a plate portion 2031 bending downwards from the rear end of the retaining portion 201 and a plurality of welding legs 2032 extending downwards from a bottom end of the plate portion 2031. In this embodiment, the plate portion 2031 is parallel to a vertical plane, and the welding legs 2032 are extending and coplanar with the plate portion 2031 to insert an external circuit board (not shown).

Each power contact 21 has a plurality of elastic contacting arms 204 extending forwards from a front end of the retaining portion 201, each contacting portion 202 is connected with and in front of the relative contacting arm 204 for mating with the complementary member. The contacting arms 204 are passing forwards through the first contact-receiving passageways 13 and received in the mating section 12.

The angle between each contacting arm 204 of the outer contact 211 and the horizontal plane is greater than the angle between each contacting arm 204 of the relative inner contact 212 and the horizontal plane, that is to say, each contacting arm 204 of the outer contact 211 has a greater slope than that of the inner contact 212. In this embodiment, each inner contact 212 further has a connecting arm 205 connecting the contacting arm 204 with the retaining portion 201, and the connecting arm 205 and the contacting arm 204 are bent and extending in opposite directions so that the angled opening between them is facing inwards (i.e., towards the interval wall 15).

Specially, take the upper contact set 2*a* as an example, the connecting arm 205 is extending forwards and bending upwards from a front end of the retaining portion 201, the contacting arm 204 is extending forwards and bending downwards from a front end of the connecting arm 205, so the angled opening between the contact arm 204 and the connecting arm 205 is downward. In further, two retaining portions 201 and the segments in front of the retaining portions 201 (including the contacting arms 204, the connecting arms 205 and the contacting portions 202) of each upper contact set 2*a* are arranged as mirror images of two retaining portions 201 and the segments in front of the retaining portions 201 of each lower contact set 2*b*.

Figure 2:
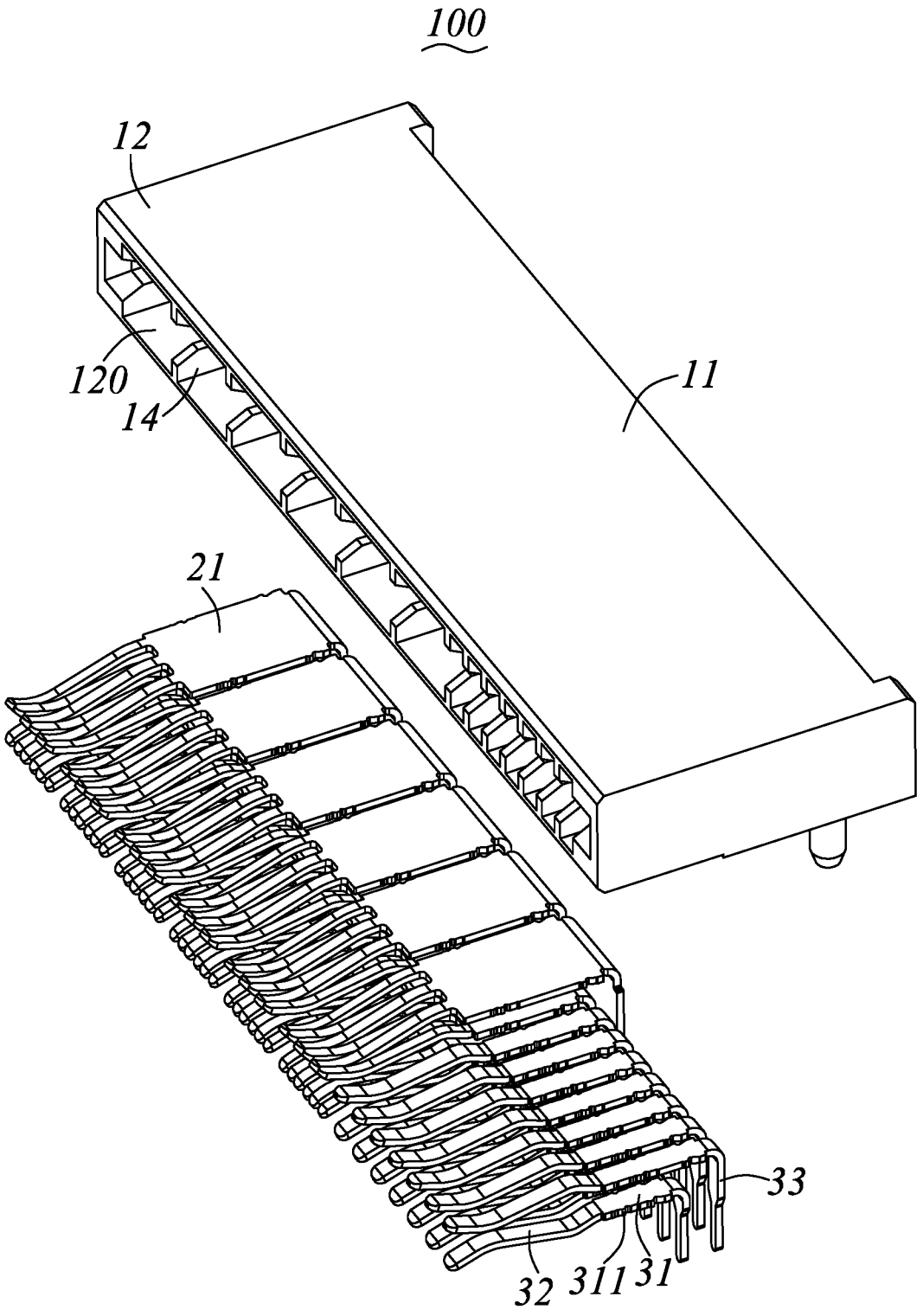
FIG. 2 is an exploded view of the electrical connector shown in FIG. 1.
Figure 3:
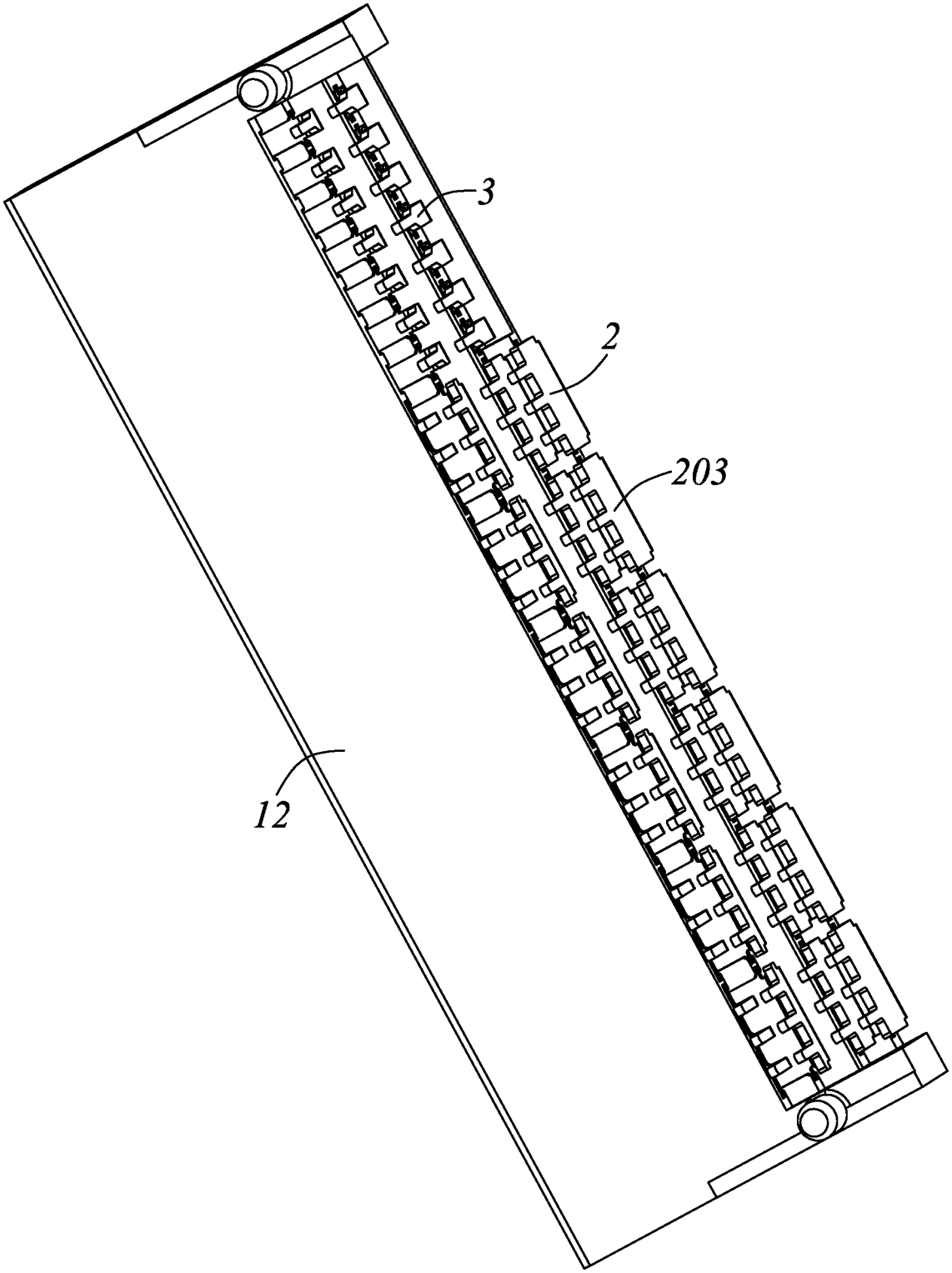
FIG. 3 is a view similar to FIG. 1, but viewed from a different angle.

Referring to FIGS. 1 to 3 and conjunction with FIG. 9, in this case, the electrical connector 100 further has a plurality of signal contacts 3 on one lateral side of the power contact pairs 2 along the transverse direction, the insulative housing 1 defines a plurality of second contact-receiving passageways 16 on one side of the first contact-receiving passageways 13.

Each signal contact 3 comprises a positioning portion 31, a mating arm 32 extending from one end of the positioning portion 31 and a soldering leg 33 extending from the other end of the positioning portion 31. The positioning portion 31 is inserted into the second contact-receiving passageways 16 from a rear side of the main section 11 and fixed in the second contact-receiving passageways 16, and the mating arm 32 in front of the positioning portion 31 is protruding into the mating section 12 to make an electrical connection with the complementary member.

In the present embodiment, the positioning portion 31 defines at least a pair of barbs 311 on both sides thereof, and the barbs 311 are engaging with the main section 11 interferentially, so the signal contacts 3 can be fixed in the insulative housing 1 to prevent the signal contacts 3 from shaking when mating with the complementary member and improve the stability of mating.

In this case, the contacting portions 202 of two power contacts 21 in each power contact pair 2 are lined up in a row in the height direction, and arranged alternately and cyclically in the transverse direction, thereby effectively increasing the current channel and reducing the heating of the power contact pairs 2, and then improving the transmission reliability of electrical connector 100.

FIGS. 10 to 13 illustrate an electrical connector in a second embodiment of the present invention, and the electrical connector includes an insulative housing 1' and a plurality of power contact pairs 2' retained in the insulative housing 1'. Herein, the insulative housing 1' and the power contact pairs 2' are similar or same as that of the first embodiment, so the description for them is omitted here for the second embodiment. The difference between the two embodiments is explained as follows.

The insulative housing 1' is provided with a number of first heat radiating channels 171' in a top wall 17' thereof, and the first heat radiating channels 171' are penetrating through the top wall 17' in a height direction thereof, and communicated with the relative first contact-receiving passageways 13' on an inner side thereof. In further, in this embodiment, two rows of first heat radiating channels 171' are disposed in the top wall 17' and aligning with each other along a front-and-back direction. The first heat radiating channels 171' in each row are arranged side by side in a transverse direction, in the front-and-back direction, each first heat radiating channel 171' in the front row has a larger length than the first heat radiating channel 171' in the rear row.

At least an upper power contact 21' in each power contact pair 2' has at least one second heat radiating channel 206', the second heat radiating channel 206' is defined in a retaining portion 201' and penetrating through the retaining portion 201' along the height direction. In this embodiment, each retaining portion 201' of two power contact 21' in each upper contact set 2*a*' is provided with the second heat radiating channel 206'. Among two power contacts 21' in each lower contact set 2*b*', only the upper power contact 21' (also known as an inner contact 212' in each lower contact set 2*b*') is provided with the second heat radiating channel 206'.

As the retaining portions 201' fixed in the corresponding first contact-receiving passageways 13', the heat generated after the power contact 21' energized can be dissipated through the second heat radiating channel 206', the first contact-receiving passageways 13' and the first heat radiating channel 171', to avoid heat accumulation inside the insulative housing 1'.

Simultaneously, a plate portion 2031' of each power contact 21' of each upper contact set 2*a*' is provided with at least one third heat radiating channel 207'. In the height direction, the third heat radiating channel 207' in an outer contact 211' has a greater length than the third heat radiating channel 207' in the relative inner contact 212'. Additionally, the projections of the third heat radiating channels 207' of the two power contacts 21' of each upper contact set 2*a*' on a vertical plane are at least partially overlapped. The projections of the third heat radiating channels 207' on the vertical plane fall into the projection of the first contact-receiving passageways 13' in a lower row on the same vertical plane. Thus, the third heat radiating channels 207' are aligning with the first contact-receiving passageways 13' in the lower row along the front-and-back direction. In this embodiment, the projections of the third heat radiating channels 207' in the inner contact 212' on the vertical plane fall into the projections of the relative third heat radiating channels 207' in the outer contact 211' on the vertical plane. Therefore, the outer dissipating channel can be larger, to facilitate dissipating heat from power contacts rapidly.

FIGS. 14-23 illustrate an electrical connector 100" according to a third embodiment of the present invention, and the electrical connector 100" is mounted on a printed circuit board 500 to form an electrical connector assembly. An insulative housing 1", power contact pairs 2" and signal contacts 3" of the electrical connector 100" in the third embodiment of the present invention are similar or same as that of the first embodiment, so the description for them is omitted here for the third embodiment. The difference is as follows:

In this embodiment, in a front-and-back direction, soldering portions 203" of two rows of power contact pairs 2" are located between a first mounting face 111" and a second mounting face 112". Retaining portions 201" of two power contacts 21" in each power contact pair 2" are stacked with each other along a height direction.

Each connecting arm 205" comprises a first connecting arm 2051" connecting a back end of a contacting arm 204" and a second connecting arm 2052" extending backwards and bending upwards from a rear end of the first connecting arm 2051" slantwise. A rear end of the second connecting arm 2052" is connecting with the retaining portion 201".

Welding legs 2032" of two power contacts 21" in each power contact pair 2" are arranged with a one-to-one correspondence, and every two corresponding welding legs 2032" are juxtaposed and constituting a welding leg group.

Figure 19:
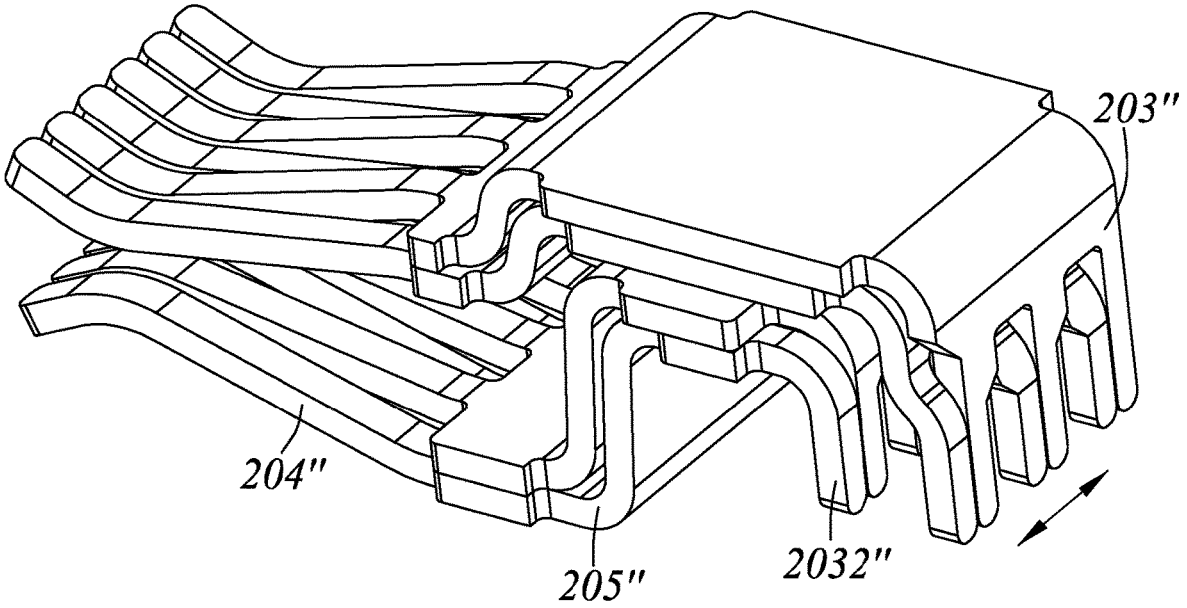
FIG. 19 is a perspective view of a power contact pair of the electrical connector shown in FIG. 18.

Specially, as shown in FIG. 19, in this embodiment, two welding legs 2032" in each welding leg group are arranged abreast and stagger along a transverse direction. In the arrangement direction (as a direction indicated by an arrow shown in FIG. 19) of the two welding legs 2032" in each welding leg group, an extending dimension L1 of each welding leg 2032" is in the range of 0.4 mm to 0.64 mm.

The printed circuit board 500 defines a plurality of through holes 51, the welding legs 2032" in a same welding leg group are inserted into a same through hole 51.

A gap G is formed between two welding legs 2032" in each welding leg group, so that solder welding to the printed circuit board 500 can be better wrapping around the welding legs 2032", to establish a stable electrical connection with the printed circuit board 500. Furthermore, as a preferred embodiment of the present invention, a width of the gap G between two welding legs 2032" in each welding leg group is in the range of 0.1 mm to 0.5 mm.

Moreover, in the arrangement direction of the two welding legs 2032" in each welding leg group, the extending dimension L1 of each welding leg 2032" is less than four times of the width of the gap G.

Figure 24:
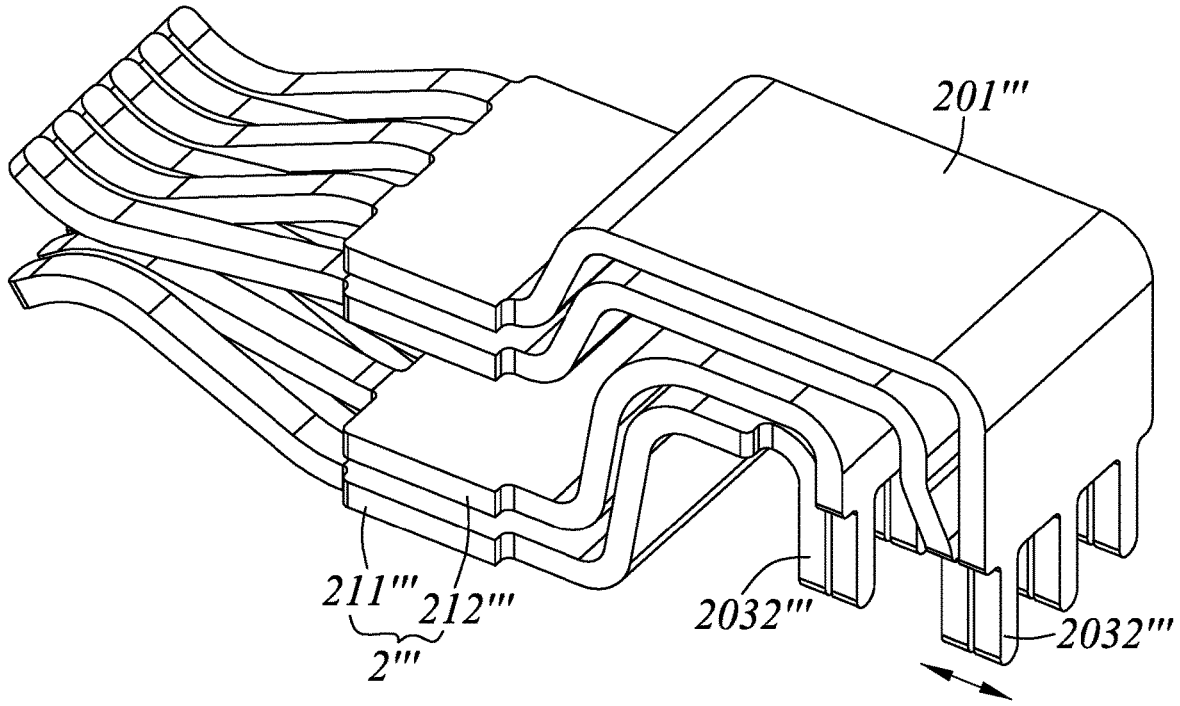
FIG. 24 is a perspective view of one power contact pair of an electrical connector according to a fourth embodiment of the present invention.
Figure 25:
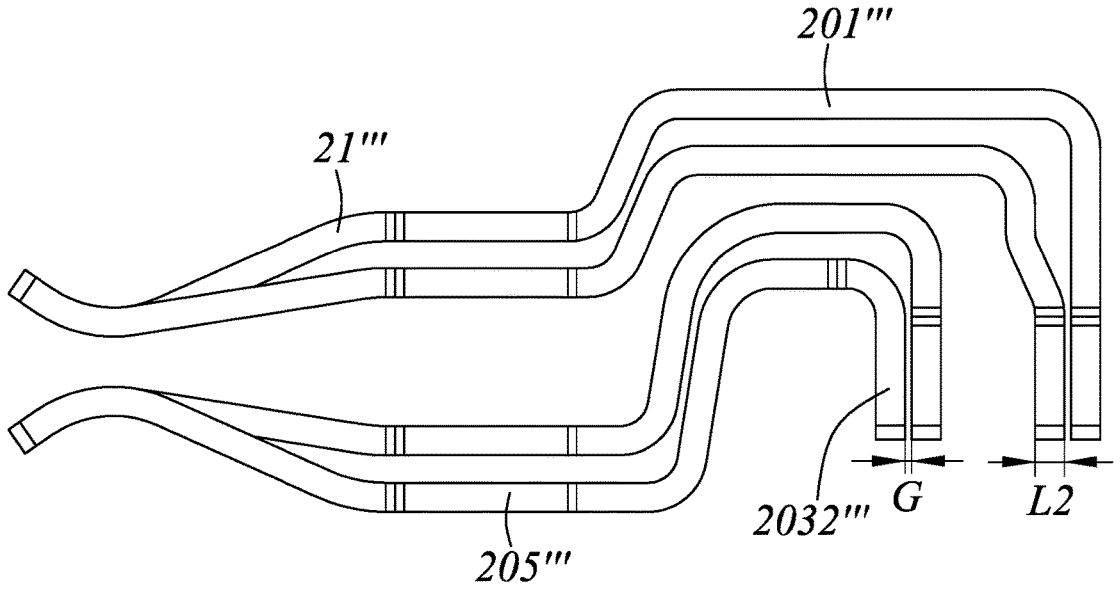
FIG. 25 is a side view of the power contact pair shown in FIG. 24.
Figure 26:
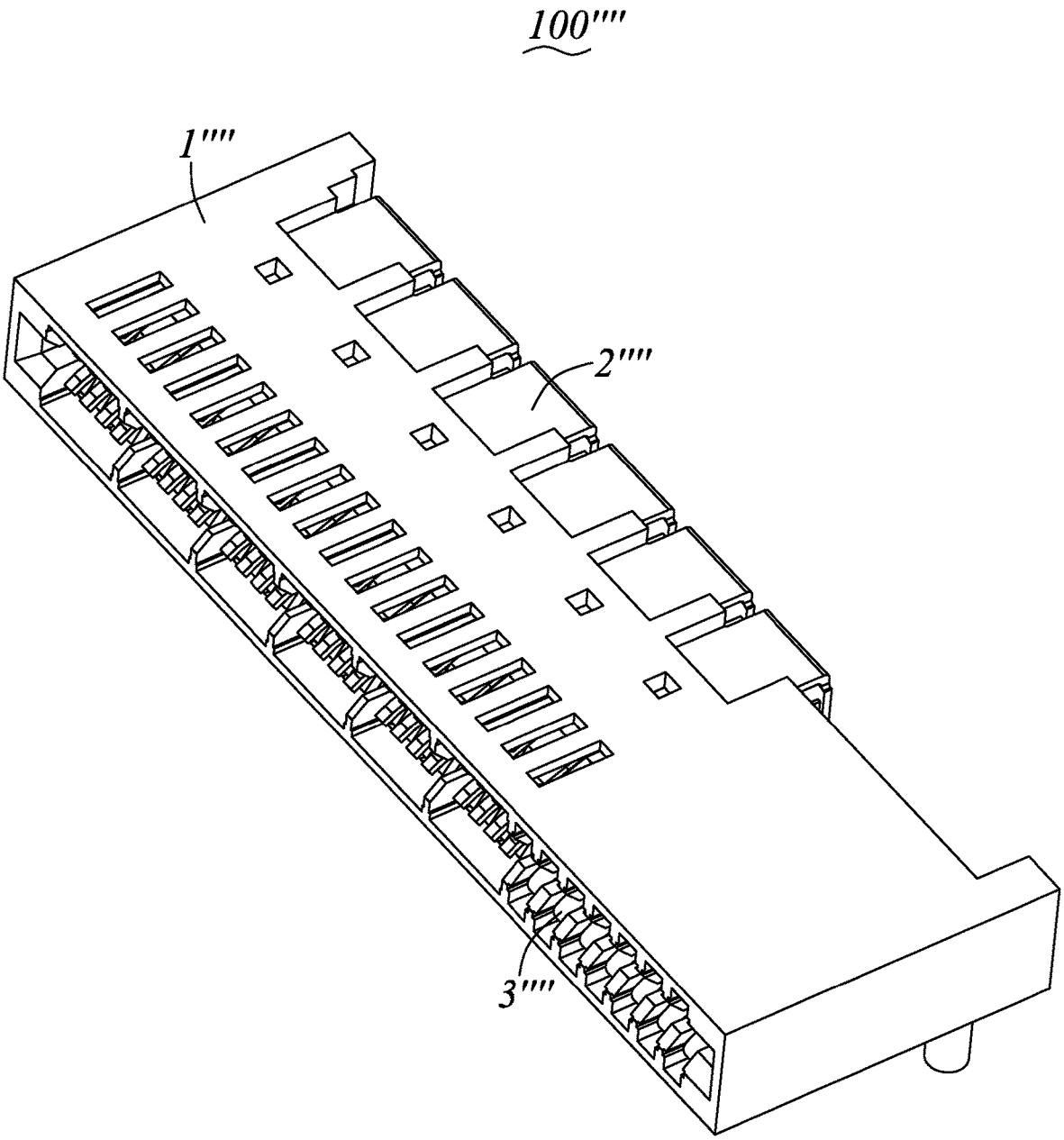
FIG. 26 is a perspective view of an electrical connector according to a fifth embodiment of the present invention.
Figure 27:
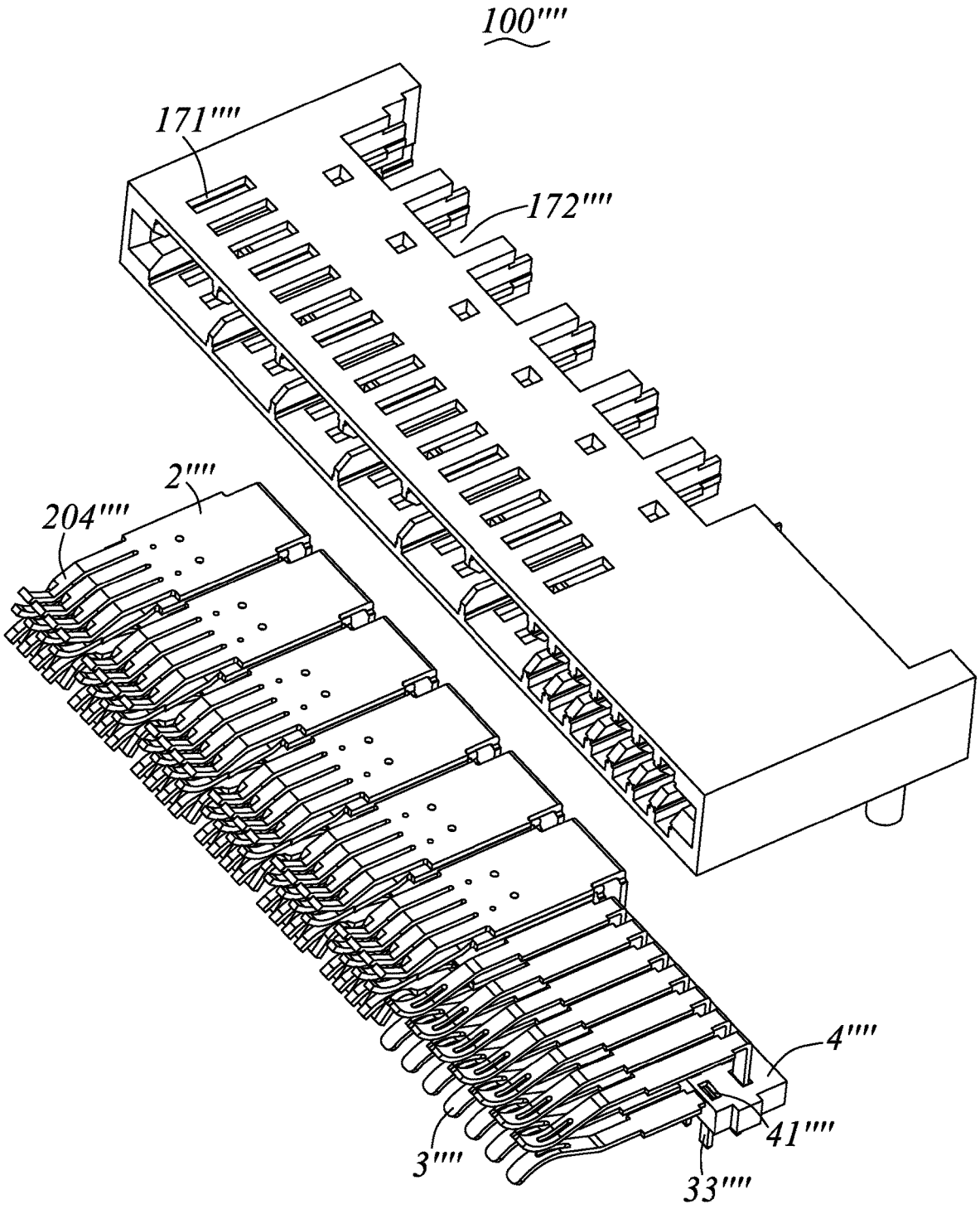
FIG. 27 is an exploded view of the electrical connector shown in FIG. 26.
Figure 28:
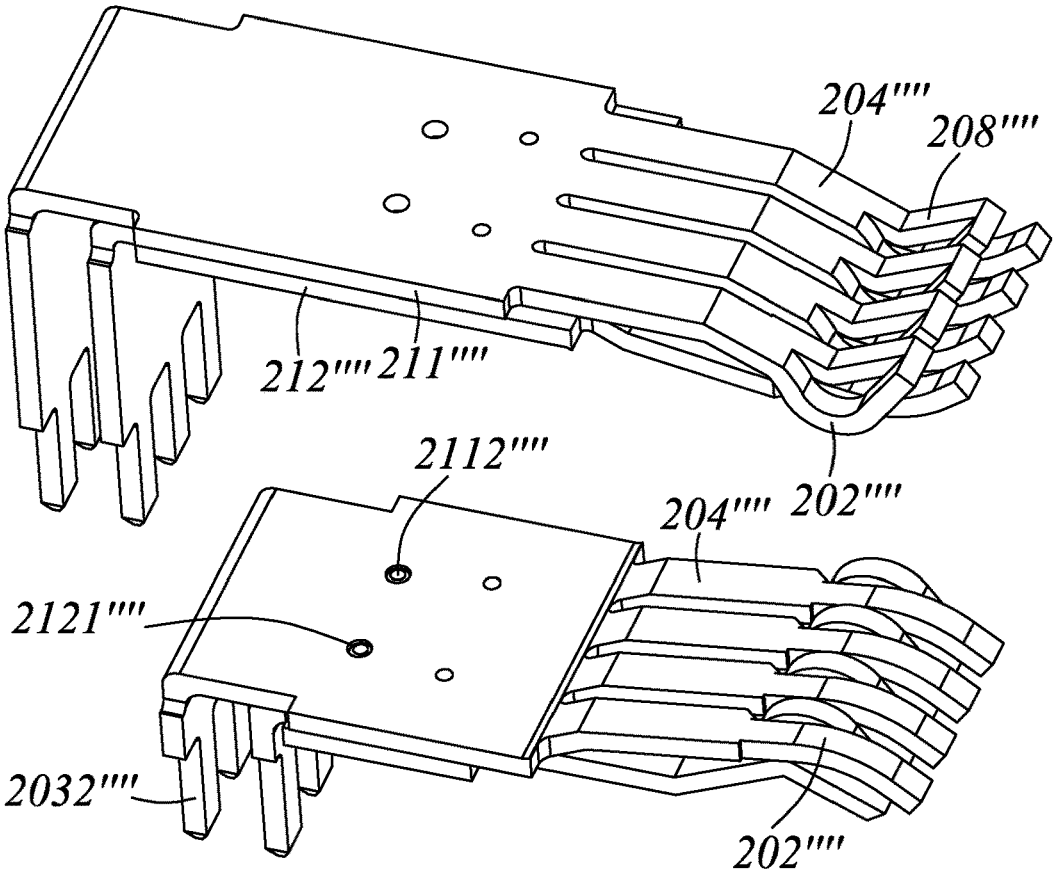
FIG. 28 is a partially exploded view of a power contact pair shown in FIG. 27.

FIGS. 24-25 illustrate a group of power contact pairs 2''' of an electrical connector according to the fourth embodiment of the present invention, and the group of power contact pairs 2''' is similar as the third embodiment, so the description for it is omitted here for the third embodiment. The difference is as follows: two welding legs 2032''' in each welding leg group are arranged abreast along a front-and-back direction. In the arrangement direction (as a direction indicated by an arrow shown in FIG. 24) of the two welding legs 2032''' in each welding leg group, an extending dimension L2 of each welding leg 2032''' is in the range of 0.4 mm to 0.64 mm.

In further, in this embodiment, among each power contact pair 2''', the welding legs 2032''' of an inner contact 212''' are aligning with the relative welding legs 2032''' of an outer contact 211''' along the front-and-back direction, and the welding legs 2032''' of the inner contact 212''' of each power contact pair 2''' in an upper row are located in front of the welding legs 2032''' of the relative outer contact 211''', the welding legs 2032''' of the inner contact 212''' of each power contact pair 2''' in a lower row are located behind the welding legs 2032''' of the relative outer contact 211'''. Additionally, both of retaining portions 201''' and connecting arms 205''' of the two power contacts 21''' in each power contact pair 2''' are spaced apart from each other along a height direction with a certain distance, thereby increasing air convection for a better heat dissipation.

Figure 20:
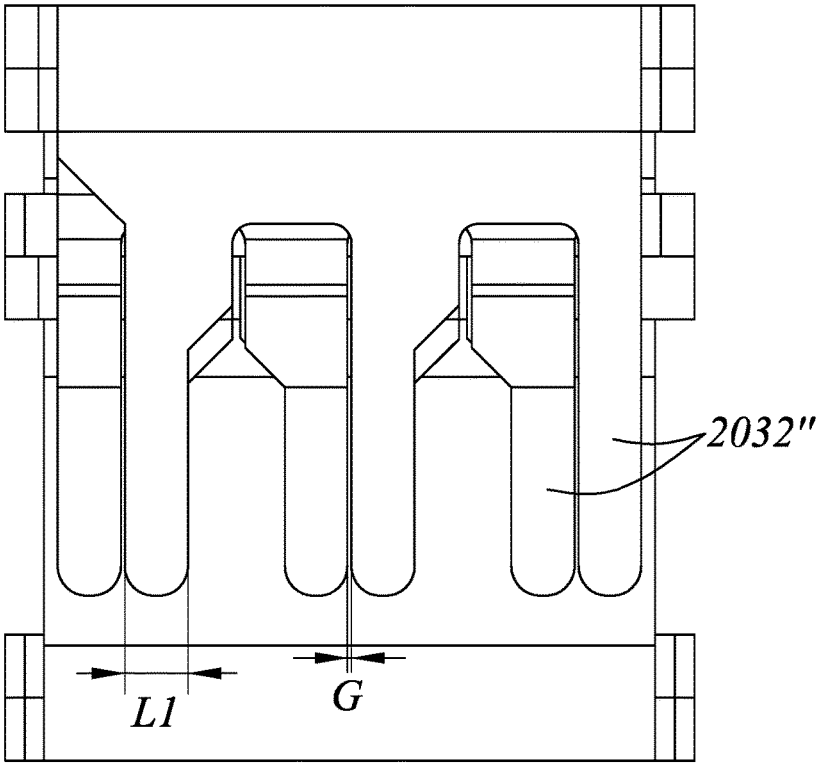
FIG. 20 is a back view of the power contact pair shown in FIG. 19.
Figure 21:
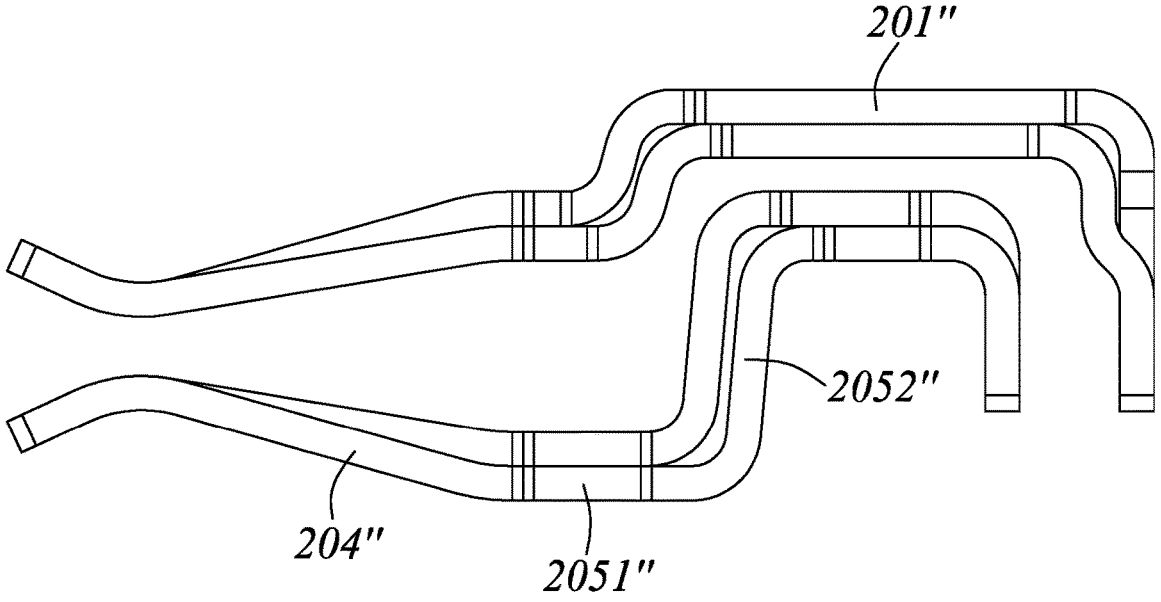
FIG. 21 is a side view of the power contact pair shown in FIG. 19.
Figure 22:
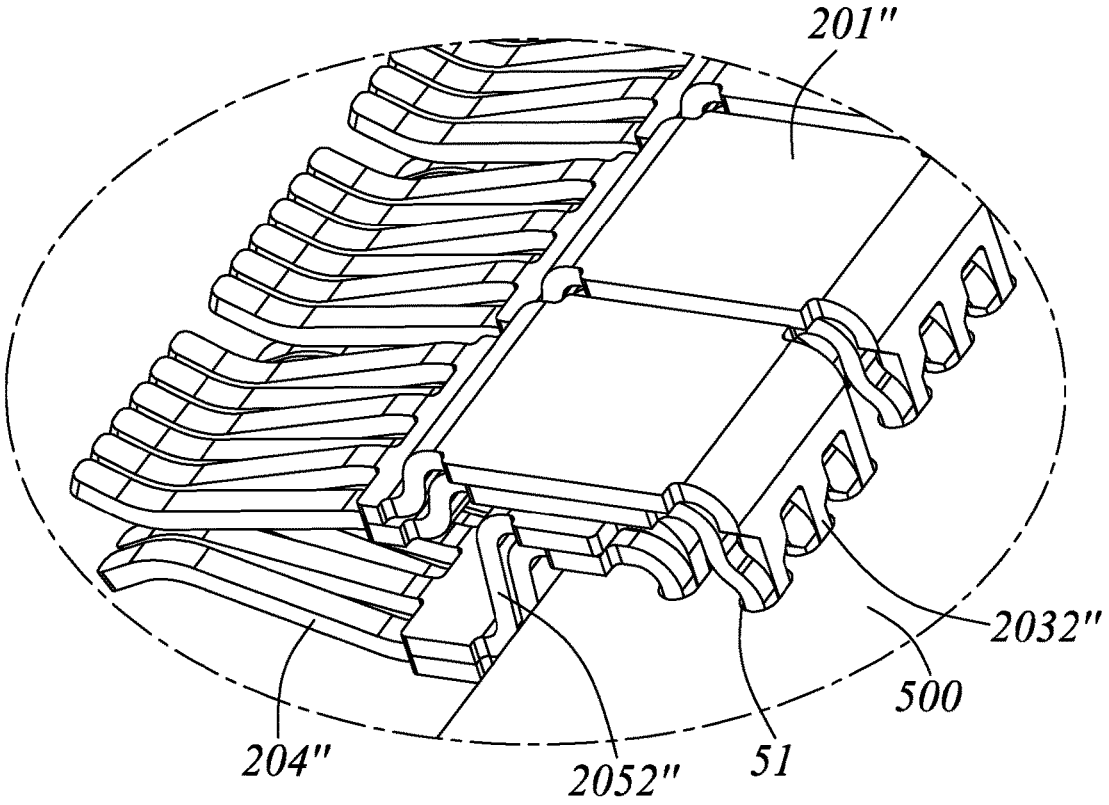
FIG. 22 is a schematic view of power contact pairs of the electrical connector installed on a printed circuit board shown in FIG. 18.
Figure 23:
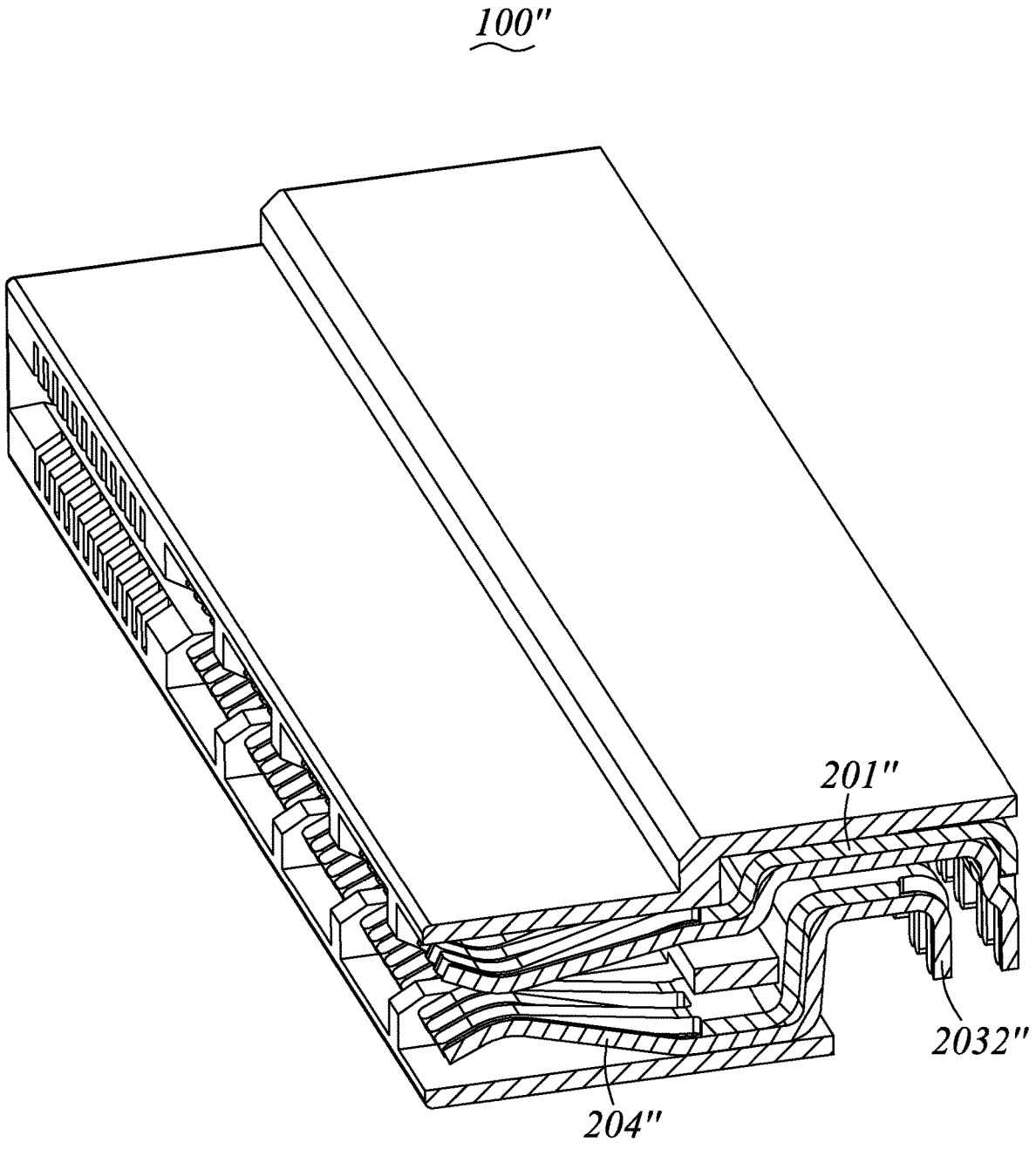
FIG. 23 is a cross-section view of the electrical connector shown in FIG. 14.

Referring to FIGS. 19-20 and conjunction with FIGS. 24-25, above all, in the third and fourth embodiments, the two welding legs 2032", 2032''' in each welding leg group are arranged abreast along the transverse direction or the front-and-back direction. Welding legs 2032", 2032''' of two power contacts 21", 21''' in each power contact pair 2", 2''' are arranged with a one-to-one correspondence, and every two corresponding welding legs 2032", 2032''' are juxtaposed and constituting the welding leg group for inserting into a same through hole of the printed circuit board 500, thus the installation of the electrical connector assembly is simplified and the height and longitudinal dimensions of the electrical connector assembly can be effectively controlled. Additionally, the contacting portions of two power contacts 21", 21'" in each power contact pair 2", 2'" are arranged alternately and cyclically, thereby effectively increasing the current channel and reducing the heating of the power contact pairs 2", 2'", and then improving the transmission reliability of electrical connector 100".

FIGS. 26-29 illustrate an electrical connector 100"" according to a fifth embodiment of the present invention, and the electrical connector 100"" comprises an insulative housing 1"", a plurality of power contact pairs 2"" and signal contacts 3"" retained in the insulative housing 1"". The insulative housing 1"" and power contact pairs 2"" of the electrical connector 100"" in the fifth embodiment of the present invention are similar or same as that of the first embodiment, so the description for them is omitted here for the fifth embodiment. The difference is as follows:

First heat radiating channels 171"" of the insulative housing 1"" are arranged in a front segment of a top wall 17"", each first heat radiating channel 171"" extends along a front-and-back direction to form a strip shape, and is located above the corresponding contacting portion 202"" to expose the contacting portion 202"" outwardly. The top wall 17"" further has a plurality of cutouts 172"" in a rear segment thereof, and the cutouts 172"" are communicated with corresponding first contact-receiving passageway. A rear section of each power contact pairs 2"" is exposed in relative cutout 172"".

An outer contact 211"" of each power contact pair 2"" comprises a plurality of contacting portions 202"" and a plurality of base portions 208"" in front of contacting arms 204"", one contacting portion 202"" and one base portion 208"" are extending forwards from each contacting arm 204"", and the base portion 208"" is located on one side of the contacting portion 202"" in a transverse direction. In this embodiment, each contacting portion 202"" of the outer contact 211"" is tearing downwards from a lateral side of the corresponding base portion 208"", and arched inwards so that the contacting areas 2020"" of the outer contact 211"" is roughly aligned with the contact area 2020"" of the corresponding inner contact 21"".

Furthermore, in this embodiment, the contacting areas 2020"" of the outer contact 211"" and the contacting areas 2020"" of the inner contact 212"" are misaligned in the front-and-back direction. In further, as shown in FIG. 29, in each power contact pair 2"" along the front-and-back direction, the contacting areas 2020"" of the outer contact 211"" are placed behind the contacting areas 2020"" of the inner contact 212"".

Figure 29:
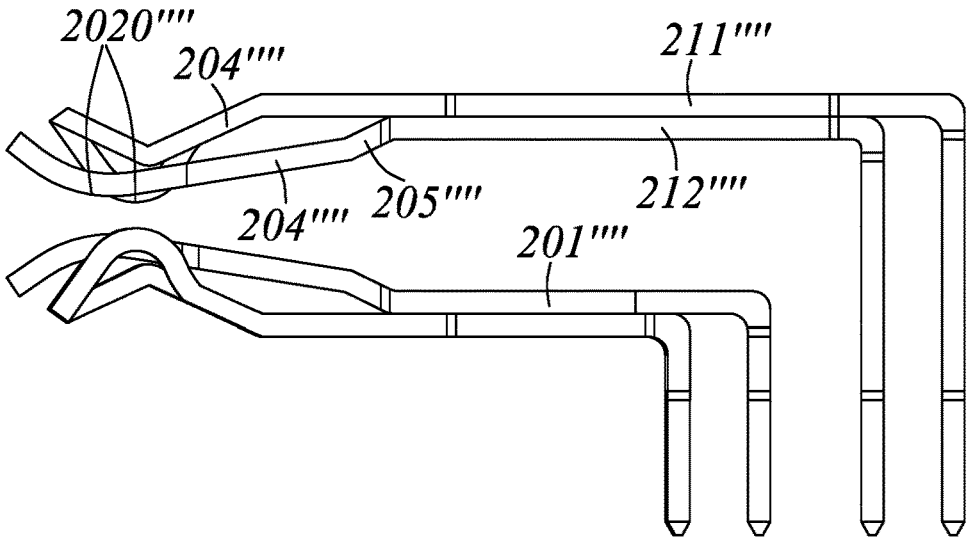
FIG. 29 is a side view of the power contact pair shown in FIG. 27.

Referring to FIG. 29, each inner contact 212"" also has a plurality of contacting arms 204"" and a plurality of connecting arms 205"" connecting the contacting arms 204"" with a retaining portion 201"". The angle between each contacting arm 204"" of the outer contact 211"" and a horizontal plane is greater than the angle between each contacting arm 204"" of the relative inner contact 212"" and the horizontal plane.

In addition, the contacting arms 204"" and the connecting arms 205"" of each inner contact 212"" are extending along a front-to-back direction with an upward tendency. However, the angle between each contacting arm 204"" of the inner contact 212"" and a horizontal plane is different from the angle between each connecting arm 205"" and the horizontal plane. In further, the angle between each connecting arm 205"" of the inner contact 212"" and a horizontal plane is greater than the angle between each contacting arm 204"" and the horizontal plane.

While the electrical connector 100"" not mating with the complementary member, the contacting areas 2020"" of the outer contacts 211"" are located on an interior side of the contacting areas 2020"" of the corresponding inner contacts 212""; and while the electrical connector 100"" mating with the complementary member, the contacting areas 2020"" of the power contact pairs 2"" in a same row are located on a same horizontal plane.

Additionally, the outer contact 211"" and the inner contact 212"" in each power contact pair 2"" are arranged along the height direction, and have a fixing structure that combine with each other so that the outer contact 211"" and the inner contact 212"" stack fixedly. In this embodiment, the fixing structure comprises a convex portion 2112"" and a positioning slot 2121"" coupling with each other, further, each outer contact 211"" has at least one convex portion 2112"" protruding towards the relative inner contact 212"", and each inner contact 212"" defines at least positioning slot 2121"" for the corresponding convex portion 2112"" being inserted and retained in. In other embodiments, the fixing structure of the outer contact 211"" and the inner contact 212"" also can be defined by transposition.

The electrical connector 100"" further has a positioning seat 4"" that can fix the power contact pairs 2"" and signal contacts 3"" in the insulative housing 1"" simultaneously, and the positioning seat 4"" is elongated and has a number of through slot 41"" for welding legs 2032"" and soldering leg 33"" passing through.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative housing having a mating cavity; and a plurality of power contact pairs correspondingly mounted in the insulative housing, each power contact pair defining an upper contact set and a lower contact set, each one of the upper contact set and the lower contact set comprising a first contact unit and a second contact unit, each one of the first contact unit and the second contact unit having a retaining portion fixed in the insulative housing and at least one contacting portion extending from the retaining portion into the mating cavity;

wherein the retaining portions of the upper contact set are arranged in a height direction of the insulative housing with the contacting portions thereof arranged in a transverse direction of the insulative housing, the retaining portions of the lower contact set are arranged in the height direction of the insulative housing with the contacting portions thereof arranged in the transverse direction of the insulative housing.

2. The electrical connector as claimed in claim 1, wherein in each upper contact set, the contacting portions of the first contact unit and the second contact unit are disposed on an upper side of the mating cavity along the height direction of the insulative housing, to contact with one side of a complementary member, and in each lower contact set, the contacting portions of the first contact unit and the second contact unit are disposed on an lower side of the mating cavity along the height direction of the insulative housing, to contact with the other side of the complementary member.

3. The electrical connector as claimed in claim 1, wherein the contacting portions of the first contact unit and the second contact unit in each upper contact set are staggered in a front-and-back direction, the contacting portions of the first contact unit and the second contact unit in each lower contact set are staggered in the front-and-back direction.

4. The electrical connector as claimed in claim 1, wherein in each upper contact set, the retaining portions of the first contact unit and the second contact unit are adjacent to each other in the height direction of the insulative housing, the contacting portions of the first contact unit and the second contact unit are adjacent to each other in the transverse direction of the insulative housing.

5. An electrical connector, comprising:

an insulative housing having a mating cavity; and a plurality of power contacts defined in the insulative housing and having a plurality of retaining portions fixed in the insulative housing and a plurality of contacting portions extending from corresponding retaining portions into the mating cavity in a same direction;

wherein a plurality of contact sets are formed by the plurality of power contacts, each contact set comprises a first power contact with the retaining portion on an upper side and a second power contact with the retaining portion on a lower side, the contacting portions of the first power contact and the second power contact in a same contact set are arranged in a transverse direction of the insulative housing to contact with a same side of a complementary member.

6. The electrical connector as claimed in claim 5, wherein the contacting portions of the power contacts are correspondingly arranged on an upper side and a lower side of a horizontal center surface of the mating cavity, to contact with opposite sides of the complementary member mechanically and electrically.

7. The electrical connector as claimed in claim 5, wherein the contacting portions of the first power contact and the second power contact in a same contact set are defined in a misaligned relationship in the transverse direction.

8. The electrical connector as claimed in claim 5, wherein in a same contact set, the retaining portions of the first power contact and the second power contact are adjacent to each other in a height direction of the insulative housing, the contacting portions are adjacent to each other in the transverse direction of the insulative housing.

* * * * *